United States Patent [19]

Richardson

[11] Patent Number: 5,007,649

[45] Date of Patent: Apr. 16, 1991

[54] GAMING SYSTEM WITH SYSTEM BASE STATION AND GAMING BOARDS

[75] Inventor: John Richardson, San Diego, Calif.

[73] Assignee: Selectro-Vision, Ltd., San Diego, Calif.

[21] Appl. No.: 329,910

[22] Filed: Mar. 28, 1989

Related U.S. Application Data

[63] Continuation-in-part of Ser. No. 820,521, Jan. 16, 1986, Pat. No. 4,848,771.

[51] Int. Cl.[5] ..... A63F 3/06

[52] U.S. Cl. ..... 273/237; 273/269; 273/138 A; 364/410

[58] Field of Search ..... 273/DIG. 28, 1 E, 237, 273/138 A, 269, 238; 364/410, 412

[56] References Cited

U.S. PATENT DOCUMENTS

| | | | |
|---|---|---|---|
| 4,365,810 | 12/1982 | Richardson | 273/237 |
| 4,378,940 | 4/1983 | Gluz et al. | 273/237 |
| 4,455,025 | 6/1984 | Itkis | 273/237 |
| 4,475,157 | 10/1984 | Bolan | 364/410 |
| 4,575,622 | 3/1986 | Pellegrini | 273/138 A |
| 4,582,324 | 4/1986 | Koza et al. | 273/138 A |
| 4,592,546 | 6/1986 | Fascenda et al. | 273/138 A |
| 4,611,808 | 9/1986 | Palmer | 273/138 A |
| 4,624,462 | 11/1986 | Itkis | 273/237 |
| 4,636,951 | 1/1987 | Harlick | 364/412 |
| 4,650,981 | 3/1987 | Foletta | 235/449 |
| 4,651,995 | 3/1987 | Henkel | 273/237 |
| 4,669,730 | 6/1987 | Small | 273/138 |
| 4,747,600 | 5/1988 | Richardson | 273/269 |
| 4,768,151 | 8/1988 | Birenbaum et al. | 364/410 |
| 4,798,387 | 1/1989 | Richardson | 273/237 |
| 4,848,711 | 7/1989 | Richardson | 273/237 |

*Primary Examiner*—Edward M. Coven
*Assistant Examiner*—Jessica J. Harrison
*Attorney, Agent, or Firm*—Fitch, Even, Tabin & Flannery

[57] ABSTRACT

An electronic gaming system for playing games. The electronic gaming system includes a system base station and a plurality of electronic gaming boards. The system base station downloads game instructions, a game schedule, and game card arrays into the gaming boards. These game card arrays are stored in the system base station as a gaming card library. The game schedule stores symbols which are to be matched with randomly generated symbols, particularly where the symbols are numbers and the pattern is a plurality of elements of a 5×5 array. The system base station retains auditing information about the distributed gaming cards; thus, the base station instantly confirms matches between the randomly-called numbers and those on a winning card, and at the same time verifies that such a card was indeed sold. The system base station receives information and performs supervisory functions such as distributing the game cards, storing the distributed game cards in memory, validating potentially winning cards, calculating card cost, calculating prize money for each session, and processing and reporting cumulative audit records stemming from the entire gaming session. The system base station has a number of modes by which an operator performs various functions for a gaming session as either the manager of the gaming session, the cashier of the gaming session, or the accountant of the gaming session. The accounting function produces a comprehensive audit record, including a profit/loss statement and a final cash-on-hand balance, for the entire gaming session.

30 Claims, 21 Drawing Sheets

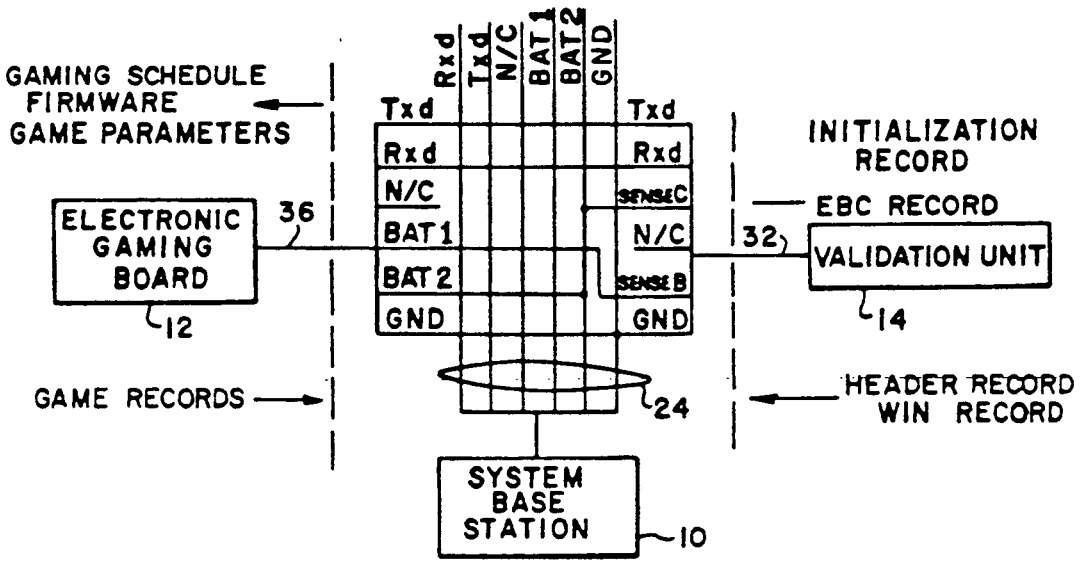

FIG. 8

INITIALIZATION RECORD (DOWNLOAD)

| |
|---|
| ASSIGNMENT CODE 8 BYTES |
| VALIDATION CODE 16 BYTES |

FIG. 9A

HEADER RECORD (UPLOAD)

| |
|---|
| NO. OF RECORDS 3 BYTES |
| NULLS 4 BYTES |
| VU SERIAL NO. 8 BYTES |

FIG. 9B

WIN RECORD (UPLOAD)

| | |
|---|---|
| PLACE | CARD |
| WIN PATTERN | |
| GAME | LEVEL |
| EBC SERIAL NO. 8 BYTES | |

FIG. 9C

EBC RECORD (UPLOAD)

| |
|---|
| FREE SPACE |
| BAR LINE |
| CARD NUM |
| PATTERN NO. |
| GAME NO. |
| LEVEL NO. |
| EBC SERIAL NO. 8 BYTES |
| VALIDATION CODE 16 BYTES |
| REGULAR CARD |
| SPECIAL CARD |
| INSTANT BINGOS |
| CHECK BYTE |

FIG. 9D

PLAYER RECEIPT

| ITEM | QTY | AMT |
|---|---|---|
| REGULAR CARDS | 10 | $20.00 |
| SPECIAL CARDS | 6 | $18.00 |
| | TOTAL | $38.00 |
| | CASH IN | $40.00 |
| | CHANGE | $2.00 |

THANK YOU FOR PLAYING BINGO... GOOD LUCK

CARD (S) SERIAL NUMBER 8N007

FIG. 11

SUMMARY REPORT FOR BINGO SESSION

BINGO SALES

| | |
|---|---|
| NO. OF CUSTOMER | 1 |
| TOTAL REGULAR CARDS SOLD | 10 |
| TOTAL SPECIAL CARDS SOLD | 6 |
| TOTAL INSTANT BINGO CARDS SOLD | 0 |
| TOTAL BINGO SALES | $38.00 |

OTHER SALES

| | |
|---|---|
| NO. OF SALES | 0 |
| TOTAL AMOUNT | $0.00 |
| TOTAL SALES | $38.00 |

PAYOUTS

| | |
|---|---|
| TOTAL BINGO PAYOUT AMOUNT | $200.00 |
| TOTAL BONUSES PAID | $0.00 |
| TOTAL OTHER PAYOUTS | $0.00 |
| TOTAL REFUNDS | $0.00 |
| TOTAL PAYOUTS | $200.00 |

NET INCOME/LOSS ( $162.00 )

FIG. 12

BINGO PRICES

DISCOUNT PERCENTAGE 50%

| | |
|---|---|
| PRICE FOR MINIMUM SALE | $10.00 |
| UNIT PRICE FOR REGULAR CARDS | $2.00 |
| UNIT PRICE FOR SPECIAL CARDS | $3.00 |

FIG. 13

INSTANT BINGO DATA

1 FOR $1.00 OR 6 FOR $5.00

INSTANT BINGO FORMAT: REGULAR BINGO
NO. OF PUSHES FOR WIN: 13
PAYOUT AMOUNT: $5.00

FIG. 14

PACKAGE DEAL DATA

TOTAL NUMBER OF PACKAGE DEALS 5

PACKAGE DEAL NO. 1

| | |
|---|---|
| REGULAR CARDS | 8 |
| SPECIAL CARDS | 4 |
| INSTANT BINGO | 6 |
| PRICE | $13.00 |

PACKAGE DEAL NO. 2

| | |
|---|---|
| REGULAR CARDS | 8 |
| SPECIAL CARDS | 6 |
| INSTANT BINGO | 6 |
| PRICE | $15.00 |

PACKAGE DEAL NO. 3

| | |
|---|---|
| REGULAR CARDS | 10 |
| SPECIAL CARDS | 8 |
| INSTANT BINGO | 12 |
| PRICE | $16.50 |

PACKAGE DEAL NO. 4

| | |
|---|---|
| REGULAR CARDS | 16 |
| SPECIAL CARDS | 8 |
| INSTANT BINGO | 12 |
| PRICE | $27.50 |

PACKAGE DEAL NO. 5

| | |
|---|---|
| REGULAR CARDS | 20 |
| SPECIAL CARDS | 12 |
| INSTANT BINGO | 12 |
| PRICE | $35.00 |

FIG. 15

FORMAT LIBRARY

| NUMBER | NAME | PATTERN VALUE |
|---|---|---|
| 1 | REGULAR BINGO | 12 |
| 2 | REG. INCL 4 CORS | 13 |
| 3 | P. 1 LAYER CAKE | 3 |
| 4 | P. 2 LAYER CAKE | 3 |
| 5 | FULL LAYER CAKE | 1 |
| 6 | P. 1 OUTSIDE SQ. | 4 |
| 7 | P. 2 OUTSIDE SQ. | 6 |
| 8 | P. 3 OUTSIDE SQ. | 4 |
| 9 | FULL OUTSIDE SQ. | 1 |
| 10 | INSIDE SQUARE | 1 |
| 11 | COVER ALL BLKOUT | 1 |
| 12 | P. 1 RAIL. TRACKS | 2 |
| 13 | RAILROAD TRACKS | 1 |
| 14 | 6 NUMBER BINGO | 8 |
| 15 | 9 IN A SQUARE | 9 |
| 16 | CRAZY KITE | 4 |
| 17 | STAMPS DIAGONAL | 2 |
| 18 | CUPID'S ARROW | 1 |
| 19 | CRAZY LETTER "E" | 4 |
| 20 | CRAZY LETTER "F" | 6 |
| 21 | CRAZY LETTER "H" | 2 |
| 22 | CRAZY LETTER "L" | 4 |
| 23 | CRAZY LETTER "S" | 2 |
| 24 | CRAZY LETTER "T" | 4 |
| 25 | LETTER "X" | 1 |
| 26 | CRAZY LETTER "Z" | 2 |
| 27 | NUMBER 7 | 1 |
| 28 | LARGE DIAMOND | 1 |
| 29 | SML DIA OR CROSS | 1 |
| 30 | SMALL CROSS/4 COR | 1 |
| 31 | BRACKET | 1 |
| 32 | H I | 1 |
| 33 | LARGE CROSS | 1 |
| 34 | HOUR GLASS | 1 |
| 35 | HOUSE | 1 |
| 36 | DOUBLE CROSS | 1 |
| 37 | SNOWFLAKE | 1 |
| 38 | TREETOP | 1 |
| 39 | LORRAINE CROSS | 1 |
| 40 | TEST | 1 |
| 41 | CHECKERBOARD | 1 |
| 42 | CRAZY LETTER 'S' | 2 |
| 43 | | |
| 44 | | |
| 45 | | |

FIG. 16

GAME FORMAT

| NUMBER | NAME | PATTERNS |
|---|---|---|
| 43 | LETTER J | 1 |

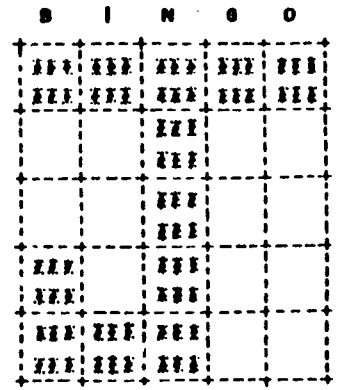

FIG. 17

GAME SCHEDULE DATA

| R/S | GAM | LEV | FORMAT NAME | PAYOUTS | |
|---|---|---|---|---|---|
| R | 1 | 1 | REGULAR BINGO | 1 | 200.00 |
| | | | | 2 | 50.00 |
| S | 2 | 1 | LETTER "X" | 1 | 150.00 |
| | | | | 2 | 50.00 |
| R | 3 | 1 | P. 1 OUTSIDE SQ. | 1 | 20.00 |
| R | 3 | 2 | P. 2 OUTSIDE SQ. | 1 | 30.00 |
| R | 3 | 3 | P.3 OUTSIDE SQ. | 1 | 40.00 |
| R | 3 | 4 | FULL OUTSIDE SQ. | 1 | 150.00 |
| R | 4 | 1 | REGULAR BINGO | 1 | 50.00 |
| R | 4 | 2 | COVER ALL BLKOUT | 1 | 150.00 |
| | | | | 2 | 50.00 |
| R | 5 | 1 | 5 NUMBER BINGO | 1 | 150.00 |
| | | | | 2 | 75.00 |
| S | 6 | 1 | STAMPS DIAGONAL | 1 | 200.00 |
| | | | | 2 | 50.00 |
| R | 7 | 1 | REG. INCL 4 CORS | 1 | 150.00 |
| | | | | 2 | 50.00 |
| R | 8 | 1 | SMALL CROSS/4 COR | 1 | 125.00 |
| | | | | 2 | 75.00 |
| R | 9 | 1 | CRAZY LETTER "T" | 1 | 200.00 |
| | | | | 2 | 50.00 |
| S | 10 | 1 | COVER ALL BLKOUT | 1 | 250.00 |
| R | 11 | 1 | REGULAR BINGO | 1 | 175.00 |
| | | | | 2 | 50.00 |
| R | 12 | 1 | 9 IN A SQUARE | 1 | 200.00 |
| | | | | 2 | 50.00 |
| S | 13 | 1 | LARGE DIAMOND | 1 | 200.00 |
| | | | | 2 | 50.00 |
| S | 14 | 1 | COVER ALL BLKOUT | 1 | 200.00 |
| | | | | 2 | 50.00 |

FIG. 18

HARDWARE DIAGRAM
SYSTEM BASE STATION 10

HARDWARE DIAGRAM
GAMING BOARD 12

LCD DISPLAY
ROW
DRIVER
ROWCLK
ADDRESS BUS
DATA BUS
LATCH
COLCLK
LCDDAT
LCDOCS
PROCESSOR
ALE
WR
RD
PSEN
INT
RST
SS
EA
PROC
XTAL
ADAPTER #8
BAT1
BAT2
GND
TxD
RxD
R0
R1
R2
R3
C1C2C3C4

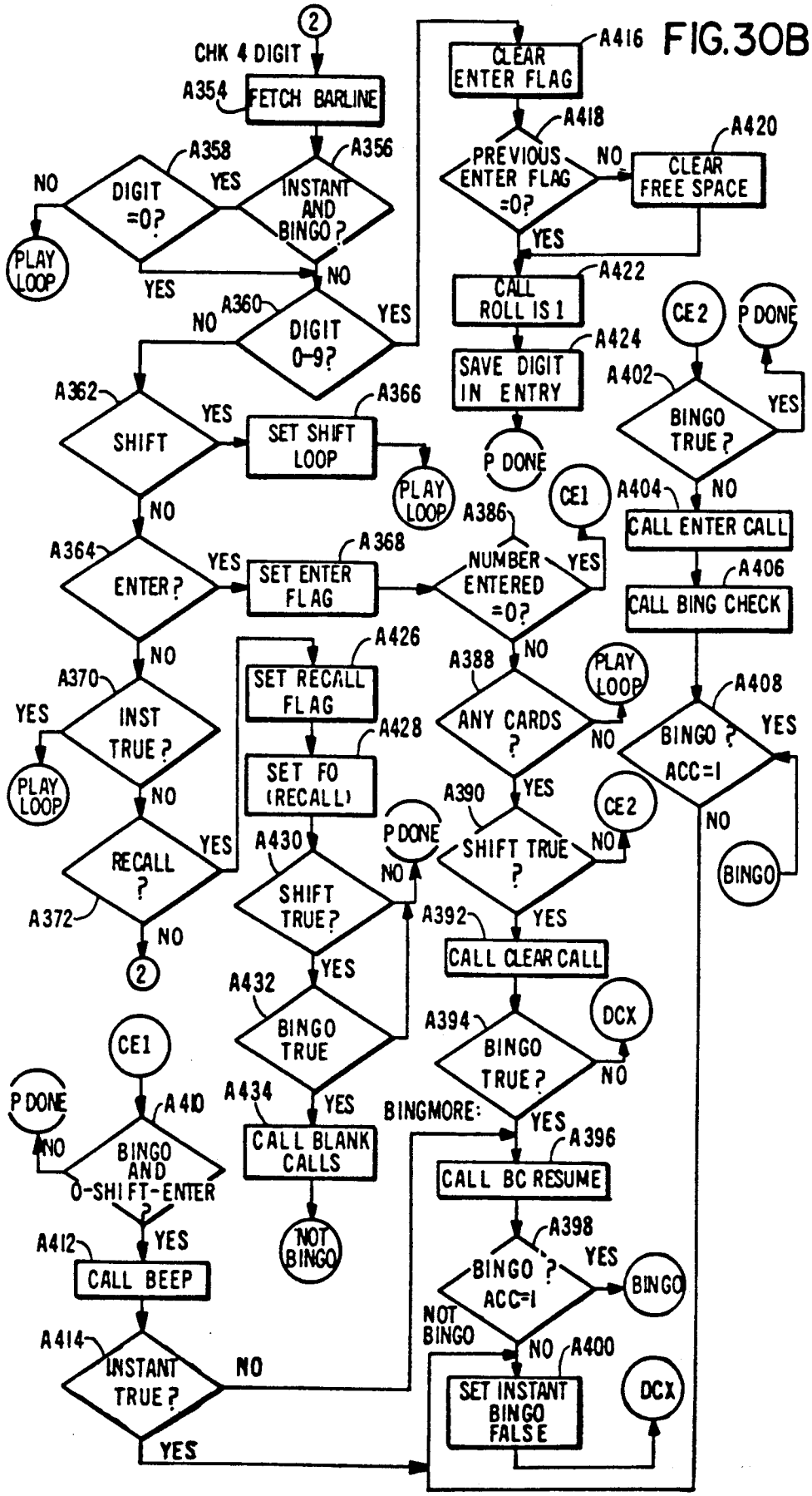
FIG.30B
CHK 4 DIGIT
A354
FETCH BARLINE
A356
INSTANT AND BINGO ?
A358
DIGIT =0?
NO
YES
PLAY LOOP
A360
DIGIT 0-9?
A362
SHIFT
A366
SET SHIFT LOOP
A364
ENTER?
A368
SET ENTER FLAG
A370
INST TRUE ?
A372
RECALL ?
A426
SET RECALL FLAG
A428
SET FO (RECALL)
A430
SHIFT TRUE?
A432
BINGO TRUE
A434
CALL BLANK CALLS
NOT BINGO
A410
BINGO AND 0-SHIFT-ENTER ?
A412
CALL BEEP
A414
INSTANT TRUE ?
A416
CLEAR ENTER FLAG
A418
PREVIOUS ENTER FLAG =0?
A420
CLEAR FREE SPACE
A422
CALL ROLL IS 1
A424
SAVE DIGIT IN ENTRY
P DONE
A386
NUMBER ENTERED =0?
CE1
A388
ANY CARDS ?
A390
SHIFT TRUE ?
CE2
A392
CALL CLEAR CALL
A394
BINGO TRUE ?
DCX
BINGMORE:
A396
CALL BC RESUME
A398
BINGO ? ACC=1
BINGO
A400
SET INSTANT BINGO FALSE
A402
BINGO TRUE ?
A404
CALL ENTER CALL
A406
CALL BING CHECK
A408
BINGO ? ACC=1

GAMING SYSTEM WITH SYSTEM BASE STATION AND GAMING BOARDS

CROSS-REFERENCE TO RELATED APPLICATION

The present application is a continuation-in-part of application U.S. Ser. No. 06/820,521, now U.S. Pat. No. 4,848,771, filed on Jan. 16, 1986, by the present applicant now U.S. Pat. No. 4,848,771, entitled "Automatic Gaming System", issued on July 18, 1989.

FIELD OF THE INVENTION

The invention pertains generally to games of chance, such as bingo and the like, and is more particularly directed to automatic gaming system including an interactive system base station and a plurality of electronic gaming boards. Further, the invention is directed to such automatic gaming systems including a plurality of validation units with which to validate win claims for the electronic gaming boards.

BACKGROUND OF THE INVENTION

In bingo and similar games of chance the basic elements of the game are a gaming board and a random number generating device. The gaming board can be a square array of numbers, usually a 5×5 array, with the centermost location being blank or termed a "free space". The game is generally played with either 75 or 90 numbers. Each column in the array is limited to only one-fifth of the numbers, e.g., the first column numbers are taken from the group 1 to 15 in the event 75 numbers are used, and 1 to 18 if 90 numbers are used; the second column numbers are taken from the group 16 to 30 or 19 to 36, and so on. Further, duplicate numbers cannot appear on a gaming card.

When the game is being played, the game operator specifies a shape or pattern to be formed on the gaming card by randomly drawn numbers and then proceeds to call numbers at random between 1 and 75, or 1 and 90, whichever is appropriate. If a number called coincides with one on a player's board, the player marks the number in some fashion on his board. The object of the game is to be the first player to have a set of randomly-called numbers coincide with the marked numbers on the player's board so as to form the specified shape or pattern. The specified shape or pattern may be an X, T, L, a diagonal line, any five numbers horizontally or vertically, and so on. Several of these games, usually between twelve and eighteen, constitute a bingo program or session which is played during the course of an evening over several hours. The games are played consecutively and essentially without any major interruption except possibly for intermissions.

These games have long been played with boards which have a fixed printed numerical array. Players select from a large number of boards and, therefore, are unable to create and play an array of their own choosing and determination. While some games have been played with blank paper boards that are filled in with numbers of the player's own choosing, the cards are limited in size and can essentially be used only once since the player marks out the numbers called with an ink dauber or like means. This type of random array selection results in an inefficiency of operation for playing consecutive games on a minimum interruption basis.

This inefficiency affects not only the game operator, who must find and check a copy of the marked paper boards which are collected to avoid an unauthorized change in the numbers once the game has started, but also the player, who must prepare a new board prior to each game. These actions require time and detract from the desired even, and essentially uninterrupted, flow of a successful bingo program. It is mainly for these reasons that the blank board approach has been used only for single games and then generally only for the first game of the bingo program.

Another important factor is to provide a gaming board which cannot be changed without the knowledge of the game operator, which provides an indication that it was acquired for use in the particular program being conducted, and which can be checked quickly in the event it displays a winning combination. Furthermore, during a typical bingo program, the shape of the winning array generally varies from one game to the next. Therefore, it is desirable for the player to have the shape of a winning array promptly displayed on his board and, additionally, to be provided with an automatic indication of when a match for that array has been achieved.

Recently, electronic gaming boards have been developed which permit a player to select his own numbers and to display the shape of a winning array. These boards signal the player when a winning array has been achieved on his board. An electronic gaming board of this type is more fully described in U.S. Pat. No. 4,365,810 issued in the name of John Richardson on Dec. 28, 1982. Other advantageous electronic gaming systems are disclosed in pending application U.S. Ser. No. 820,521 of John Richardson entitled, "Automatic Gaming System"; U.S. Pat. No. 4,798,387 issued to John Richardson, entitled "Multiple Gaming Board"; and U.S. Pat. No. 4,747,600 issued to John Richardson, entitled "Multiple Gaming Board With Instant Win Feature". The disclosures of Richardson are hereby expressly incorporated by reference.

Even with the improvement in game play brought about by electronic gaming boards, the play during a bingo gaming session has become much more complex. More and different types of games are played today than just the five across, up or down of traditional bingo. Specialized win patterns for each game are becoming commonplace, and it would be impractical to provide a select switch for every possible pattern. Additionally, the gaming schedules are complicated by playing either regular cards or special cards for a particular game. It is necessary for a player to recognize and determine which type of card and game is being played for a particular gaming schedule.

To further complicate matters, in a single game there may be multiple win patterns or levels that build to a final payoff. For example, the final win pattern may be three completely-filled horizontal bars comprising the first, third, and fifth rows of a card. The first-level win pattern may be the fifth row, the second-level win pattern may be the first and fifth rows, and the third-level win pattern may be the first, third and fifth rows. The final payoff is given to the first player to totally fill all three bars. It is difficult with presently configured electronic gaming boards to play different game levels conveniently. These complex schedules become even more difficult to play when considering that many players will desire multiple cards or boards.

Moreover, many bingo gaming sessions today offer place payouts where there is a declining amount for a sequence of wins. The first person matching a particular pattern receives a substantial first prize, a moderate prize is awarded to the second person matching the same pattern, a lesser amount is paid to the third person matching the same pattern, and so on. These place-type games are also more difficult to play on presently-configured electronic gaming boards.

One of the more popular pastimes during intermission at a bingo gaming session is "instant" or "break open" bingo. While this game can be played in a variety of different ways and on different types of cards, the principle of the game is essentially the same. The players purchase cards where all the numbers are covered by pull tabs and no caller is involved. The player simply peels off or breaks open the tab and if the card contains B, I, N, G, O in any order or rotation, it is scored as a win. Because prior-art electronic gaming boards cannot be used to play this game, an operator is required to use two different types of cards and to employ more people to sell these instant cards.

For security reasons, the above-referenced electronic gaming boards of Richardson use a timer which, after a predetermined amount of time has elapsed, locks out the board from play if the purchased card(s) have not been filled. While accomplishing its security purpose, this operation for an electronic gaming board causes the gaming session to be somewhat more inflexible than is necessary. For example, if every gaming board is set for a predetermined time, then no gaming cards can be sold within that interval before starting the game or the session cannot begin on time. These predetermined time periods, if fixed for all the boards, make it difficult to buy cards between games of a gaming session or at intermission. Moreover, there are players who do not want to choose their own numbers and consider it an imposition to have to fill out a gaming card on an electronic board. Further, an operator must make some provision for those players who have already paid for cards, but because the time for filling in the cards has elapsed, will not play in a particular game or gaming session.

An electronic gaming board as described in U.S. Pat. No. 4,747,600, issued to John Richardson and entitled "Gaming Board with Instant Win Feature", provides for the storage of a complex gaming schedule therein to produce arbitrary win patterns with multiple level and place formats. These electronic gaming boards have produced a need for a means by which the gaming operator can easily program a large number of the boards in a rapid manner with a completely arbitrary gaming schedule. The gaming operator further needs a means to assist him in formulating the complex gaming schedule from one gaming session to the next.

Another problem which confronts the operator when using electronic gaming boards, or even regular paper cards, is the lack of available auditing procedures. Because a winning player is paid in cash at the time of his win, if some inconsistency develops either in the amount paid for one game or the total amount paid over all the games, there is no practical means for correcting the error.

The increased volume of card sales demands a more efficient distribution mechanism. Present art requires players to input numbers laboriously into their gaming boards, or to wait as a random number generator fills their cards. This procedure is time-consuming, precluding additional card sales.

A gaming system which is designed to improve the efficiency of a typical bingo gaming session should provide a gaming board which cannot be changed without the knowledge of the game operator, and which can be checked quickly in the event it displays a winning combination. The system should provide an indication that the gaming board was acquired for use in the particular program being conducted. Further, because each individual game during a typical bingo gaming session generally requires a different shape for the winning pattern, it would be desirable for the player to have the shape of a winning array displayed promptly on his board and to be provided with an automatic indication when a match for that array has been achieved.

Under prior electronic bingo gaming systems, a number of deceptions can be practiced. For instance, in some systems, it has been possible for a player to generate favorable cards on an electronic gaming board as the random numbers were announced. It has also been possible for a player to use an old game card in a new game, and to utilize electronic means to "verify" an improperly secured "win." Unscrupulous players might attempt to collect prize money by playing on electronic gaming boards from other bingo gaming operations. Similarly, game participants could modify the electronic gaming boards to enhance the chances of winning. Therefore, electronic gaming systems must provide security checks to ensure that allegedly-winning electronic gaming boards belong to the gaming system in question and have not been modified. Otherwise, the profitability of an entire bingo operation may be jeopardized.

An electronic validation unit as described in copending application Ser. No. 820,245, entitled "Portable Validation Unit for Gaming System," filed in the name of John Richardson, provides for the operation of validating win claims for electronic gaming boards, such as those described immediately above, and for accumulating an audit record of the win claim. These validation units have produced a need for a means by which the gaming operator can easily program the units to validate the wins of a complex gaming schedule and to assemble the separate audit information from each validation unit into an integrated audit record for the entire gaming session.

Because the electronic gaming boards and validation units described above are hand-held, battery-powered apparatus, a considerable maintenance cost for such boards is changing the batteries. Generally, such hand-held, battery-powered devices have an on/off switch which connects and disconnects a battery from the circuitry such that power can be conserved during non-use. However, in a gaming session context, an operator does not want a player to be able to turn on and off an electronic gaming board, or an employee to be able to turn on and off a validation unit, for a number of reasons.

Initially, if the electronic gaming board or validation unit stores information in a random-access memory, turning off the device during the gaming session will excise this information from memory. Secondly, for security purposes as much as for power savings, the gaming operator does not want an electronic gaming board or validation unit operable until the start of the gaming session and then would prefer it to be disabled after the gaming session is complete. This type of operation would prevent unauthorized use and persons from storing or reading data from the electronic gaming board or validation unit which might affect the play of the game.

SUMMARY OF THE INVENTION

The invention solves these and other problems for a bingo gaming session, or the like, by providing an automatic gaming system comprised of a system base station and a plurality of electronic gaming boards. The system further includes, in another preferred embodiment, a plurality of validation units with which to validate the win claims for the electronic gaming boards.

The system base station is a data processing and control means which includes means for inputting information into a processor means. The processor means includes means for visually displaying data and means for communicating with either the electronic gaming boards or the validation units. Preferably, the system base station comprises a microprocessor based disk operating system which runs an interactive application program receiving operator inputs and providing system control, communications, and auditing functions for the electronic gaming boards and the validation units.

The system base station has a number of modes by which an operator through the input means performs various functions for a gaming session as either the manager of the gaming session, the cashier of the gaming session, or an accountant at the end of the session developing an audit record for the complete gaming session.

During the cashier mode, the system base station provides automatic means by which to download a plurality of gaming cards from a gaming library created beforehand into each of respective individual gaming boards. This feature obviates the time-consuming and cumbersome task of creating and entering values into the 24 array positions in each gaming card. Furthermore, this downloading feature allows the base station to retain auditing information about the distributed gaming cards; thus, the base station can instantly confirm matches between the randomly-called numbers and those on a winning card, and at the same time verify that such a card was indeed sold.

In the manager mode, a complex gaming schedule can be assembled with an interactive routine which provides data for a gaming schedule. The routine provides the choice of selecting a win pattern from a format library of patterns or the choice of inputting an entirely arbitrary win pattern. From the selected win patterns, a gaming schedule is generated which is limited only by the imagination and ingenuity of the scheduler by interspersing regular and special gaming cards, multiple win places and multiple win levels in a arbitrary order. Any time before the gaming session begins this schedule can be reformatted, deleted from, added to, etc. The manager or scheduler has complete discretion in the game schedule formation and changes thereto and is provided with means for accomplishing these tasks in a facile manner.

In addition, the system when in a manager mode permits the selection of a validation code which is unique to the particular gaming session to be played. The validation code will be loaded into all of the electronic gaming boards and validation units to provide a security check for the devices being played and presenting win claims during the gaming session.

The system in the manager mode also provides means to set a real time clock and to set a start time for a gaming session. When the electronic gaming boards are loaded with the gaming schedule, they are additionally loaded with information pertaining to the time remaining prior to the start of a game, i.e., the difference between the real time and the start time. The players have the amount of time before the start of the gaming session to load arbitrary arrays for the number of cards they have purchased before the electronic gaming boards lock out the load mode and switch to the play mode. Because the electronic gaming boards are initialized at different times, this feature permits each board to count down its own variable time interval before the starting time so that all the gaming boards will switch to a play mode together.

An aspect of the invention is using the system base station, during the cashier mode, to turn on and initialize each electronic gaming board and each validation unit by connection to a communications means.

The complex interactive routine wherein gaming cards are downloaded from a library of cards to the individual player's gaming board is a primary aspect of the invention. A plurality of gaming cards are created beforehand and stored as a library in a random access file, on either a hard disk or floppy disk of the base computer. By utilizing an offset procedure, the 24 numbers for each array, ranging from 1 to 75 (or 1 to 90), are packed into 12 bytes. In a total of 600,000 bytes, 50,000 gaming cards are stored, each 12 bytes long.

The gaming cards are downloaded into a respective player's gaming board or handset as a string of 1024 bytes. The first 528 bytes contain instructions to be executed by the gaming board, while the remaining bytes provide the data for up to 40 gaming card arrays. The communication between the base computer and the handset is based upon a special asynchronous serial communications routine.

One aspect of the invention is using the system base station in conjunction with the gaming card library to instantaneously provide gaming card arrays to be downloaded into the individual gaming units. Another aspect of the invention is using the base station gaming card library to maintain valuable control and auditing information.

Another aspect of the invention is using the system base station, during the accounting mode, to form an audit record of the gaming session and to upload audit information from each validation unit and then turn it off.

These and other objects, features, and aspects of the invention will become apparent upon reading the following detailed description when taken in conjunction with the attached drawings wherein:

BRIEF DESCRIPTION OF THE DRAWINGS

FIG. 8 is a block diagram view of the system base station illustrated in FIG. 1 showing its electrical connection to either an electronic gaming board or a validation unit;

FIGS. 9A—9D are pictorial representations of the data packages which are transferred between the system base station and a validation unit;

FIGS. 11—18 are pictorial representations of printouts from the various modes of the system base station illustrated in FIG. 1.

FIGS. 30A, 30B, and 30C together comprise a more detailed flowchart of the play mode routine illustrated in FIGS. 26A and 26B.

DETAILED DESCRIPTION OF THE PREFERRED EMBODIMENTS

Figure 1:
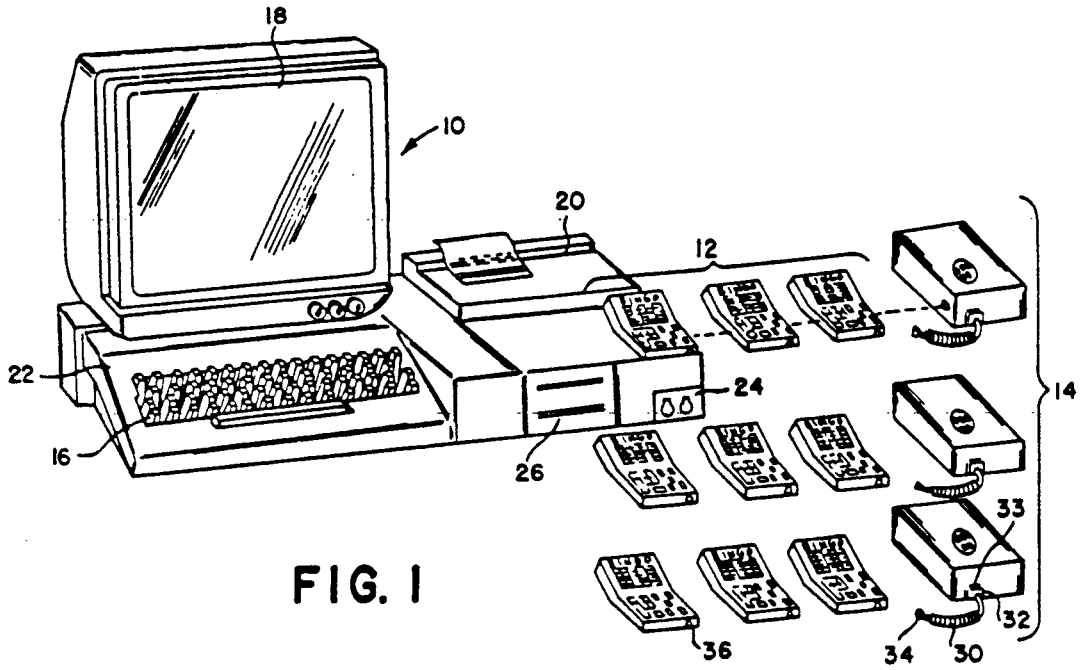
FIG. 1 is a pictorial representation of an automatic gaming system including a system base station, a plurality of electronic gaming boards, and a plurality of validation units which are constructed in accordance with the invention.

In FIG. 1 there is shown an automatic gaming system, preferably an electronic bingo system, constructed in accordance with the invention. The electronic bingo system comprises three major components including a system base station 10, a plurality of electronic bingo or gaming boards 12, and a plurality of validation units 14. The system base station 10 includes a keyboard 16, a video monitor 18, a printer 20, a computer or processor means 22, a communications cradle 24, and a dual floppy disk drive 26. The elements 10–26 are connected as a specialized data processing system.

The system base station 10 is microprocessor controlled and functions as a system control, point of sale terminal, and an accounting or auditing center. The system base station 10 uses the communications cradle unit 24 to communicate with any of the electronic gaming boards 12 or any of the validation units 14 such that data can be transferred between the devices. The electronic gaming boards 12 are used by players in place of physical paper cards and markers which traditionally have been used in the game of bingo. A software control program is used to operate the system base station 10. Preferably, the processor means 22 is under control of an operating system loaded into the memory of the station 10 through one drive of the dual drive 26. The software control program is then loaded from the other drive of the dual drive 26 and executed as an application program of the operating system.

In general, each electronic gaming board 12 is in turn connected through cradle 24 to the system base station 10 during an initialization step such that the board is downloaded with a gaming schedule so that a player may use it in a series of games termed a gaming session. The electronic gaming boards 12 are also downloaded from the system base station 10 with an assignment code, a validation code, game parameters, and optionally, firmware to execute. Preferably, the electronic gaming boards 12 are those having the features described in U.S. Pat. No. 4,747,600, entitled "Gaming Board with Instant Win Feature", issued to John Richardson.

During a first mode, the player loads game arrays into an electronic gaming board 12 by arbitrarily selecting the symbols (numbers) which comprise each of the bingo cards he has purchased. After loading, the gaming boards 12 enter a second or play mode where matching the called numbers from an operator takes place. As the numbers of a particular game are called, the player enters those numbers into the electronic gaming board 12 to determine if they match any numbers of one of the bingo cards contained therein. A particular game in the session is played until one or more of the electronic gaming boards 12 signals, audibly and by a visual indicator, that the game has been won. A payout is made using the validation units 14 and play is resumed until an entire gaming schedule is completed.

The validation units 14 are additionally initialized by connection to the cradle 24 of the system base station 10 and receive an assignment code and the validation code for the particular gaming session. When a player scores a bingo, or other type of winning combination, one of the validation units 14 is used to verify that the win wa legitimate. At the time of verification, information specific to a win is recorded within the validation unit 14 and later these stored data records are uploaded to the system base station 10 via the cradle 24. Preferably, the validation units 14 are those having the features described in the Richardson application Ser. No. 820,245 entitled "Portable Validation Unit for Gaming System".

As more fully detailed in FIGS. 1 and 8, the electronic gaming boards 12 communicate with either the system base station 10 or one of the validation units 14 through a serial digital communications interface including an adaptor plug 36 (FIG. 1). The adaptor plug 36 is a six pin female type telephone jack which is available for connection with the other devices. The validation unit 14 connects to the adaptor plug 36 through a cable 30 with a male plug end 34. The cable 30 has another male plug end 32 which connects to a similar adaptor plug 33 of the validation unit 14.

When an operator needs to validate an electronic gaming board 12, he plugs the cable end 34 into the connector 36 in the bottom of the board 12 and then listens for an audible annunciation by the validation unit 14. There are several distinguishable audible annunciations available from the validation unit 14, each indicating a different status for an electronic gaming board 12.

Connection of the electronic gaming board 12 to the system base station 10 is through a male plug of the cradle 24 which is received in the adaptor plug 36. The pins of the adaptor plug 36 form a serial data transmit line TxD, a serial data receive line Rxd, two low voltage detection lines BAT1, BAT2, a nonconnected pin NC, and ground. These pins connect to similarly labeled pins of the cradle 24 and plug end 34 of the validation units 14.

The validation units 14 additionally communicate with the system base station 10 through the serial communications interface including the adaptor plug 33. The adaptor plug 33 is a six pin female telephone type jack which is available for connection with the other devices. The coiled cable 30 with two male plugs end 32, 34 (FIG. 1) extends from the jack to connect the validation unit 14 to the system base station 10 at a female plug of the cradle 24. The pins of the adaptor plug 33 form a serial data transmit line TxD, a serial data receive line RxD, two sense lines-sense B, C, a low battery detection line BAT1, and ground. These pins connect to similarly labeled pins in the cradle 24 and adapter plug 36 of the boards 12.

Figure 10A:
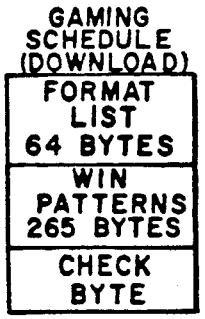
FIGS. 10A—10F are pictorial representations of data packages which are transferred between the system base station and an electronic gaming board.
Figure 10B:
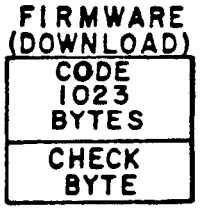
Figure 10C:
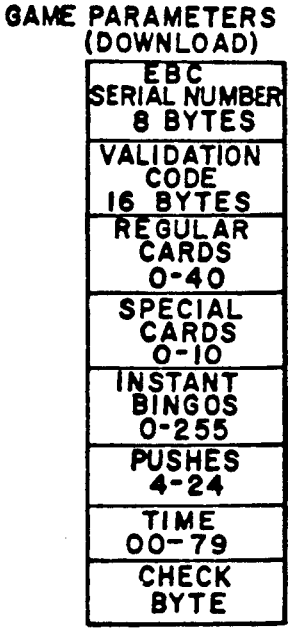

The system base station 10 can download through the communications interface cradle 24 to an electronic game board 12 three different types of data blocks as illustrated in FIGS. 10A, 10B, and 10C. A gaming schedule is shown in FIG. 10A and preferably includes 64 bytes of a format list and 265 bytes of win patterns, and ends with a check byte. The second type of data block in FIG. 10B which can be downloaded into the gaming board 12 is a 1023 bytes of firmware which is terminated by a check byte. The block of firmware is executable by the gaming board 12 upon a special sequence of key actuations or commands. It is used for special security applications or other functions.

The last block of data which can be downloaded is a game parameters block shown in FIG. 10C. The system base station 10 assigns each gaming board 12 an 8 byte serial number defining the board and the player to which it is entrusted for the gaming session. The serial number is used for audit purposes to track the cards in play and is the first 8 bytes of the game parameters. The next 16 bytes of the game parameters is a validation code which is identically input to every gaming board 12 and validation unit 14 to define a gaming session. Next in the game parameters block is a byte indicating how many regular cards the player has purchased which can have a value between 0–40. The following byte is the number of special cards, between 0–10, purchased and, thereafter, a byte indicating the number of instant bingo games, between 0–255, purchased. The next to the last byte of information in the block indicates the number of chances available to select instant bingo spaces. The last information byte is a number between 0–79 indicating the time in minutes that a player has to load the board before it automatically switches to play mode. This variable is to ensure that play of the game starts all boards at the same actual time.

Figure 10D:
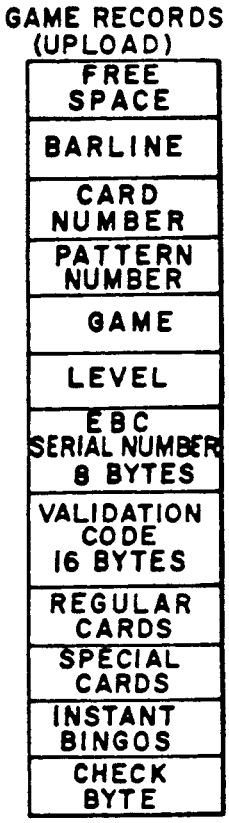

The validation unit 14 can upload a block of data from an electronic game board 12 through its communication interface 33 as illustrated in FIG. 10D. These game records or parameters are assembled internally within the gaming board 12 and are available upon command from the validation unit 14. The first six bytes of this block are the values of status indicators for the gaming board 12 at the time of a win or a validation command. The status (contents) of the free space, the annunciator bar and the pattern, game, and level of the gaming schedule are uploaded. The next 27 bytes are copies of the initialization information downloaded previously including the serial number, validation code, and the number of regular, special, and instant cards. The block ends with a check byte.

Figure 10E:
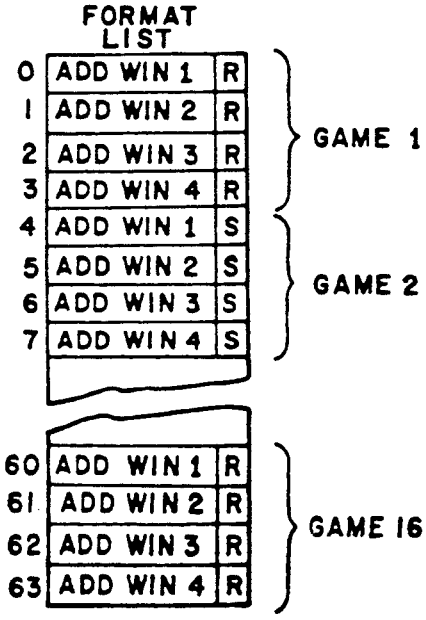
Figure 10F:
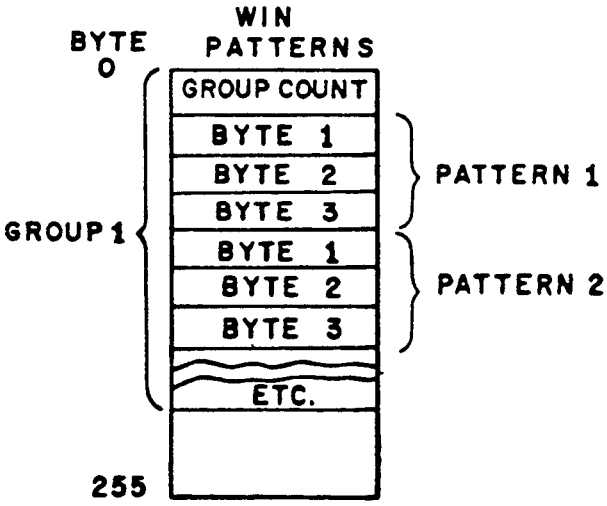

A flexible and complex gaming schedule can be formed by the system base station 10 and downloaded into each gaming board 12. FIGS. 10A, 10E, and 10F illustrate a schedule for a typical 16 game session with up to either 4 sublevels or places for each game. The schedule in FIG. 10A is separated into a format list shown in detail in FIG. 10E, and a plurality of win patterns shown in detail in FIG. 10F. The maximum of 16 games of the session are each assigned four bytes which contain addresses of win pattern groups in the win pattern bytes. Therefore, each game area of the format list points to the winning pattern for that particular game.

For different game levels, the addresses of the win pattern groups can be different each building into a more complex pattern. For different game places the addresses of the win pattern groups can be repeated. In addition combinations of place and level games may be played in this manner. For example, a two level game with a first and second place for each level can be played by storing the same win group address for the first and second byte of a game and another win group address in the third and fourth byte. It is evident that a 16 game, 4 level or place schedule that is completely in arbitrary choice, or other schedules of this type, can be used.

Each win pattern group comprises a group count byte and a plurality of 3 byte (24 bits) win patterns. Each bit of a win pattern is assigned to one of the 24 spaces of the 5×5 bingo array (free space is excluded) and a pattern is formed by selecting which spaces must be matched for a win. The selected spaces are marked (one or zero) and the remaining bits filled with the other logic value. The group count number identifies the number of ways or win patterns that will result in a win. For example, regular bingo has 12 win patterns (5 rows, 5 columns, 2 diagonals).

The validation units 14 receive from the system base station 10 when first powered on, an assignment code of eight bytes in the form of an ASCII string and a validation code of sixteen bytes in the form of ASCII string (FIG. 9A). The validation code defines the particular game schedule or session of play and can be changed as often as the operator desires. The identical validation code is also stored in each of the electronic gaming boards 12 such that it can be matched with the one stored in the validation unit 14. The assignment code is a number given by the system base station 10 to the validation unit 14 describing the particular unit and the employee to whom it is entrusted for the session.

After the validation of a winning electronic gaming board 12, an EBC record stored in the board 12 relating to the winning combination is transferred to the validation unit 14 (FIG. 9D). Thereafter, a plurality of the win records from a validation unit 14 may be uploaded to the system base station 10 for auditing purposes by two operations that upload a header record (FIG. 9B) and upload a win record (FIG. 9C). The header record is a count kept by the validation unit 14 of the number of win records it has stored and also includes the assignment code of the device and a byte forming the checksum of the information sent. A command to upload the win record causes the validation unit 14 to transfer one of its stored records about a win. The win record of an electronic gaming board 12 contains information as to the place of the win, which board the win occurred on, the win pattern, and game number. Further, the information indicates the level of the win and the serial number of the winning bingo board 12. Operationally, when the validation unit 14 is connected to the electronic gaming board 12, it is used to validate the board, validate either a regular or instant bingo, and upload the EBC records. When the validation unit 14 is connected to the system base station 10, it is used to receive the initialization record, or to upload the header records or win records.

The automatic gaming system uses a communications scheme or interface that allows the system base station 10, the electronic gaming boards 12, and the validation units 14 to act as one system. The communications interface uses an asynchronous serial communications protocol with the addition of a special handshaking routine to establish communications. The general communications protocol is a byte serial communications with one start bit, eight data bits (no parity), and one stop bit at a data rate of 4800 baud. Serial data is transmitted via the transmit line TxD of each device and received via the receive line RxD of the others.

When the gaming board 12 is connected to either the system base station 10 or the validation unit 14 it acts as a slave unit and waits for the other device to initiate the communication. In one mode, the gaming board 12 uses the BAT1 signal to signal the validation unit 14 of a connection with a high logic level. The gaming board 12 uses the BAT1 and BAT2 signals to test for low battery voltage with the system base station 10.

Figure 7A:
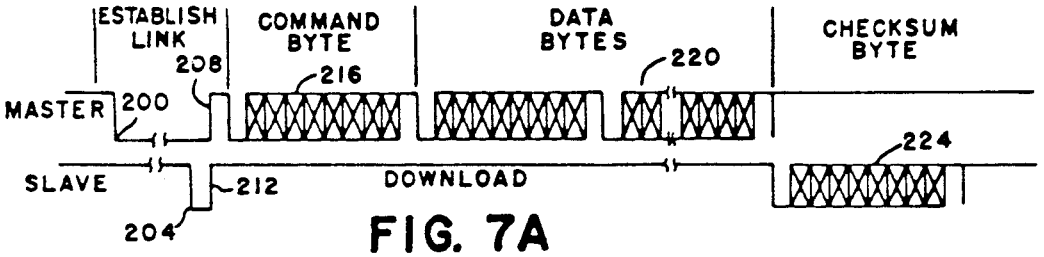
FIG. 7A is a pictorial representation of the waveforms for serial data communications for downloading information from the system base station to either the electronic gaming boards or the validation units.
Figure 7B:
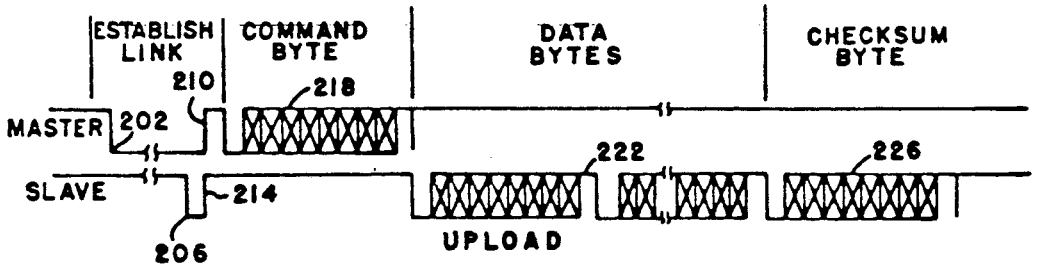
FIG. 7B is a pictorial representation of the waveforms for serial data communications for uploading information from validation units to the system base station.

When the validation unit 14 or system base station 10 detects the high logic level on the BAT1 signal line, it will establish a communications link with the gaming board 12, FIGS. 7A, 7B. The link is accomplished by the master device beginning the communications by placing a zero (break) 200 or 202 on the RxD line of the gaming board 12. This produces an interrupt to the board 12 which will be sensed by internal circuitry. The gaming board 12 will then reply with a low level response 204 or 206 by grounding its TxD line of the master device. The master device will again respond by setting the RxD input of the gaming board 12 high 208 or 210 removing the interrupt. Thereafter, the board 12 will again reply by bringing its TxD line to a high logic level 212 or 214. Once the handshake has been accomplished the link is established and data communications may take place.

The system base station 10 or the validation unit 14 will then transmit a one byte command 216 or 218 to the gaming board 12 requesting a particular operation. Depending upon which device the gaming board 12 is communicating with, it will perform either a download operation as illustrated in FIG. 7A or an upload operation as illustrated in FIG. 7B.

The command byte is an ASCII numeral from the set 1,2,3,4, and 5 (all other numbers are ignored) specifying one of five commands as follows:

"1" Download gaming schedule
"2" Download game parameters
"3" Download firmware
"4" Upload game records
"5" Power down After receiving the command byte, the gaming board 12 executes one of the five commanded operations depending upon the value of the byte. If the command byte is a "1", "2", or "3" the gaming board 12 prepares to receive (download) a block of data 220 from the system base station 10. The downloaded data blocks have been illustrated previously with respect to FIGS. 10A, 10B, and 10C. If the command byte is a "4", the gaming board 12 will transmit (upload) a block of data 222 to the validation unit 14. The uploaded data block has been previously illustrated with respect to FIG. 10D. If the command byte is a "5" from the system base station 10 or the validation unit 14, the gaming board 12 will power down and turn itself off. Any other command byte value is ignored. After these actions are completed, the gaming board breaks the communication link thereby requiring the link to be re-established for further communication to occur.

Following the data block transfers regardless of whether data went to or from the gaming board 12, a checksum byte 224 or 226 is transmitted back to the master unit. The checksum is the arithmetic sum of all the bytes transmitted after the command byte in modulo 256. For data transmitted from the gaming board 12, the validation unit 14 must match this checksum 226 to the one it calculates while receiving the data. If they match, the transfer was good and if not, the validation unit 14 is responsible to re-establish the link and reissue the upload command until a good transfer is achieved. For data transmitted to the gaming board 12, the checksum 224 must equal zero for a good data transfer as a check byte will be included in each block of data 220 to make the check sum equal to zero if the transfer is valid. Again, if the checksum 224 transmitted to the system base station 10 is not zero, then it is incumbent upon the base station to re-establish the link and reissue the communications until a good transfer is achieved.

The validation units 14 communicate with two external devices, namely the system base station 10 and the electronic gaming boards 12, through the communication interface. When the validation unit 14 is not connected to any other device, the sense C and sense B lines are held at a low logic level. These lines are used to indicate which of the two external devices are connected to the validation unit 14. The sense C line is assigned to the system base station 10 while sense B line is assigned to the electronic gaming boards 12. Therefore, the sense C line has a voltage applied to it if the system base station 10 is connected, and the sense B terminal has a voltage applied to it if an electronic gaming boards 12 is connected to the validation unit 14.

A different communications format is used depending on which device the validation unit 14 is communicating with. When the validation unit 14 is connected to an electronic gaming board 12, it initiates any communication by generating commands as a master unit as shown in FIGS. 7A, 7B. When the validation unit 14 is connected to the system base station 10, it acts as the slave unit and waits for the system base station 10 to initiate the communication.

As seen in FIG. 7B, when the validation unit 14 detects a high logic level on sense B line, it will establish a communications link with an electronic gaming board 12. The link is accomplished by the validation unit 14 beginning the communications by placing a zero (break) 202 on its transmit line TxD. The validation unit 14 will then wait for the electronic gaming board 12 to respond with a zero 206 to its receive line RxD. A low logic level on the RxD line will end an interrupt to the validation unit 14 indicating the electronic gaming board 12 has replied. Thereafter, the validation unit 14 responds by setting the data output line TxD high again at 210 and waits for the electronic gaming board 12 to do the same to its RxD line at 214. Once this has been accomplished, the link is established and data communications can take place.

The validation unit 14 will transmit a one byte command 218 to the electronic gaming board 12 requesting that it transmit its stored audit information about the present card in play and a win pattern if any. The electronic gaming board 12 transmits a block of data 222 to the validation unit 14 in byte serial format and terminates the transmission with a checksum 226. This communication protocol, more particularly illustrated in FIG. 7B, is termed an upload operation from an electronic gaming board 12 to a validation unit 14. The uploaded information is an EBC record as illustrated in FIG. 9D.

Conversely, when a validation unit 14 detects a high logic level on the sense C line, this is an indication that it is connected to the system base station 10. With the system base station 10, the validation unit 14 does not initiate communication but waits for the system base station 10 to do so. The communications can be either to upload information, FIG. 7B, or prepare for a download of information, FIG. 7A.

In the manner illustrated, the system base station 10 places a logic zero 200 or 202 on the input data line RxD of the validation unit 14. After the sense B line has detected a high logic level during the connection, the validation unit 14 continuously checks its interrupt input line to detect a zero condition on its RxD line. When a logic zero on the RxD line appears, the validation unit 14 responds with a logic level zero 204 or 206 on its output data line TxD. The handshake is completed when the system base station 10 detects the logic zero, and in response thereto, returns its TxD line to a logic level one 208 or 210. The system base station 10 then waits for the validation unit 14 to sense the return to a high level of the TxD line and to brings its output data line back to a logic level of one at 212 or 214. This procedure establishes the communications link.

After the communications link has been established, the validation unit 14 waits to receive a command 216 or 218 from the system base station 10 and will idle waiting for the command as long as the sense C line is held high. If the sense C line goes low, then the link will have to be reestablished before any communications can occur. The system base station 10 thereafter, sends a command byte to the validation unit 14 to request a certain operation.

The command byte is an ASCII numeral from the set 2, 5, 6, and 7 (all other numbers are ignored) specifying one of four commands as follows:

"2" Download Assignment and Validation Code
"5" Power Down
"6" Upload Header Record
"7" Upload Next Record After receiving the command byte, the validation unit 14 executes one of the four commanded operations depending upon the value of the byte. If the command byte is a "2" the validation unit 14 prepares to receive (download) a block of data 220 from the system base station 10. The data block which is downloaded is as shown in FIG. 9A. If the command byte is a "6" or "7", the validation unit 14 will transmit (upload) a block of data 222 as previously described in FIGS. 9B and 9C, respectively. If the command byte is a "5" from the system base station 10, the validation unit 14 will power down and turn itself off. Any other command byte value is ignored. After these actions are completed, the validation unit 14 breaks the communications link thereby requiring the link to be reestablished for further communication to occur.

Following the data block transfers regardless of whether data went to or from the validation unit 14, a checksum byte 224 or 226 is transmitted to the system base station 10. The checksum is the arithmetic sum of all the bytes transmitted after the command byte in modulo 256. For data transmitted from the validation unit 14 (upload), the system base station 10 must match this checksum 226 to the one it calculates while receiving the data. If they match, the transfer was good and, if not, the system base station 10 is responsible to reestablish the link and reissue the command until a good transfer is achieved. For data transmitted to the validation unit 14 (download), the checksum 224 must equal zero as a check byte will be included in each block of data to make the checksum equal zero if the transfer is valid. If the checksum transmitted to the system base station 10 is not zero, then it is incumbent upon the system base station 10 to reestablish the link and reissue the communication until a good transfer is achieved.

The main program which controls the system base station 10 is an interactive software package which allows an operator of the system base station 10 to perform particular functions for the automatic gaming system. In general, the main operational modes of the system are a manager mode, a cashier mode, and an accounting mode. The manager mode is used to initialize the system parameters, provide security information, and develop a gaming schedule. The cashier mode allows the system base station 10 to operate as a point of sale terminal for initializing the validation units 14 and for selling games on the electronic gaming boards to patrons. Further, it permits the cashier to make refunds and payouts during the play of the gaming session. The accounting mode is used after the gaming session to provide an audit record of the card sales, the payouts, and refunds. In this manner an integrated gaming system is provided whereby the system base station forms a focus for providing the functions needed to efficiently and automatically run a gaming session, particularly a bingo gaming session.

Figure 2:
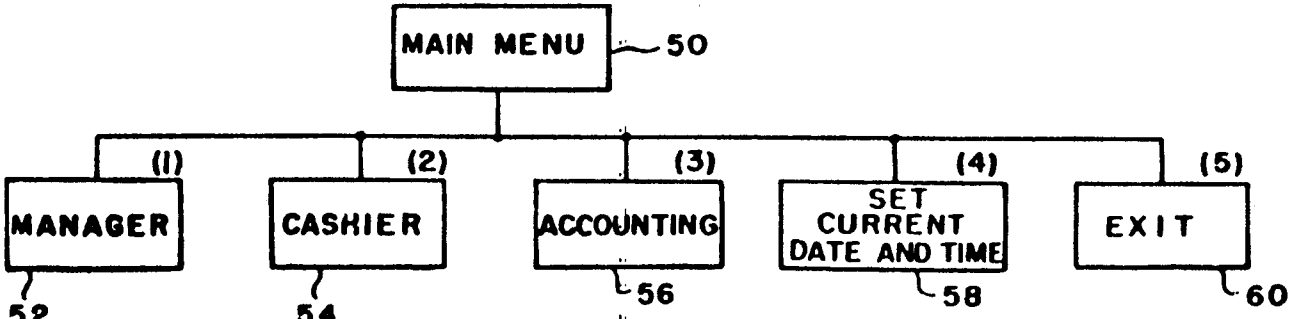
FIG. 2 is a pictorial representation of the menu of a software control program MAIN regulating the operations of the system base station illustrated in FIG. 1.

With respect now to FIG. 2, the main program is entered through a MAIN menu 50 which has a number of selections or choices which the operator can branch to by pressing a particular key. The MAIN menu 50 that the operator will produce on the display 18 during the initial part of the program consists of five selections. The operator can either select the manager mode 52, the cashier mode 54, or the accounting mode 56 of the program for the system base station 10. Further, by selecting a fourth routine in block 58, he can set the current date and time of a real time clock which is used to provide a variable time interval for loading the electronic gaming boards 12. In general, the routine which embodies the operational block 58 depends upon the internal hardware of the system of the system base station 10 illustrated in FIG. 1. Conventionally disk operating systems which are compatible with MS-DOS or PC-DOS include means and instructions for setting a real time clock. The routine 58 will produce a prompt on the screen of the display means 18 of the system base station 10 requesting an input of the current date and time from the operator on keyboard 16. In response to his input, the current date and time will be stored in the real time clock module of the hardware and the system will update that setting in increments of time from that point.

Figure 3:
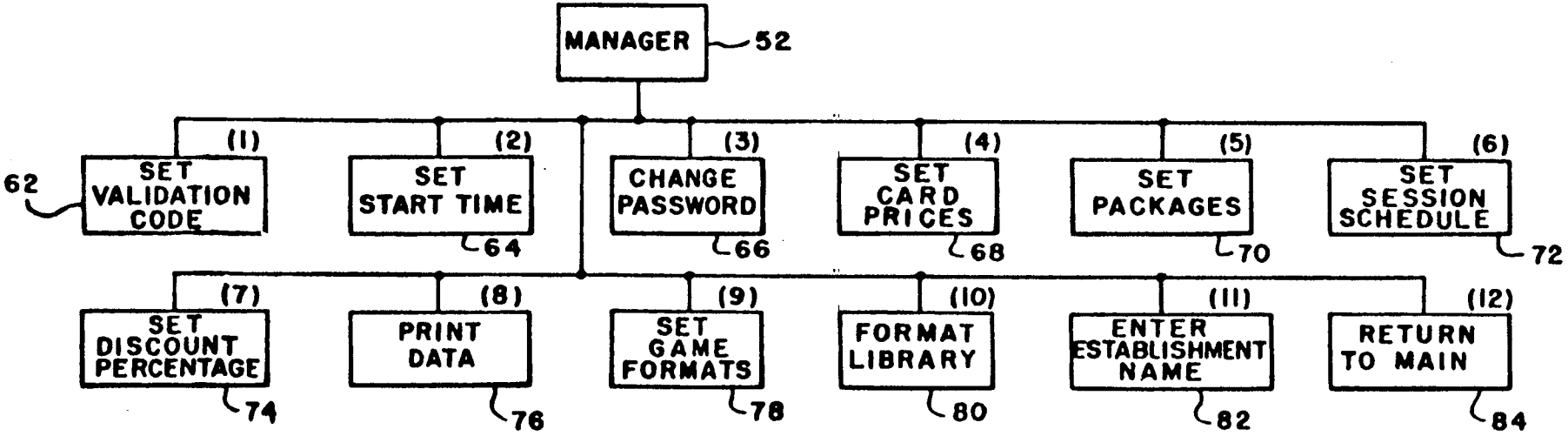
FIG. 3 is a pictorial representation of the menu of the MANAGER routine which can be selected from the MAIN menu illustrated in FIG. 2.

The manager mode routine 52 is more fully illustrated in FIG. 3 and is also an interactive menu oriented routine. Selecting the routine 52 from the MAIN menu 50 causes a MANAGER menu 52 providing twelve choices or selections to be displayed on the monitor 18 of the system base station 10. The first choice is a routine 62 which allows the operator to set the validation code. The routine requests the operator by means of a visual prompt on display means 18 to enter a 16-byte arbitrary code. This code can be input either as numbers, letters, or symbols and in any order. The manager mode 52 is used at this point to set the validation code for the entire gaming session. The validation code can at any time before the start of the play and the programming of the electronic gaming boards 12 and validation units 14 be changed or updated if the operator believes the system has been compromised.

Another selection of the manager mode 52 allows a routine 64 to be called to set the start time of the gaming session. The routine 64 permits the operator to set one beginning time for the gaming session so that all of the electronic gaming boards 12 will be playable at the same time. Further, this feature allows extra cards to be sold during intermissions by ensuring that they will start together at the end of the intermission. When the routine 52 is selected, the operator is prompted with a request to enter the start time on the display 18. After this operation is successfully completed, the program will return to the manager menu 52.

A selection of routine 66 by the operator when in the manager mode 52, will provide means for changing the password which is used to gain entrance to the main program. When in this mode the program prompts the operator with a message to enter a new password. In response to the prompt, the operator will type in a six digit or longer identifier which is then sued by the manager to access the main program at the next gaming session.

The fourth selection, a routine 68, allows the operator to set the selling prices of each card. In response to a prompt for each kin of card available, the operator inputs a price which is used thereafter to calculate audit records for the system. A further option, routine 70, allows a group of package prices to be charged for different combinations of cards and instant bingos. A routine 74 can be selected to set the discount percentages for purchasing any number of games or combination of games. Printouts of the selection of variables by these options from operator is shown in FIG. 1B for price data and discount percentage. FIG. 15 illustrates a printout after the selection of the package variables for the gaming session.

Three selection of the MANAGER routine namely routine 72, routine 78, and routine 80, allow for the formation of a complex gaming schedule which is completely arbitrary in nature. The program called by the selection of routine 78 allows the gaming operator to set the game formats and routine 80 allows him to call up a format library. An example of a format library which has been printed is shown in FIG. 16 but is in the same data which would be shown on display 18 for the interactive routine. The format library is a set of predetermined win patterns which can be chosen from to select a number of different game formats in the routine 78. After the format of each game is chosen, the routine 72 is called to set the gaming session schedule by inserting the particular format chosen into a schedule and entering the number of levels and win combinations available to the player. Further, data as to the amount of payoff for each game and whether a regular or special card is required are selected. An example of a game schedule selected in this manner is illustrated in FIG. 18.

Figure 5:
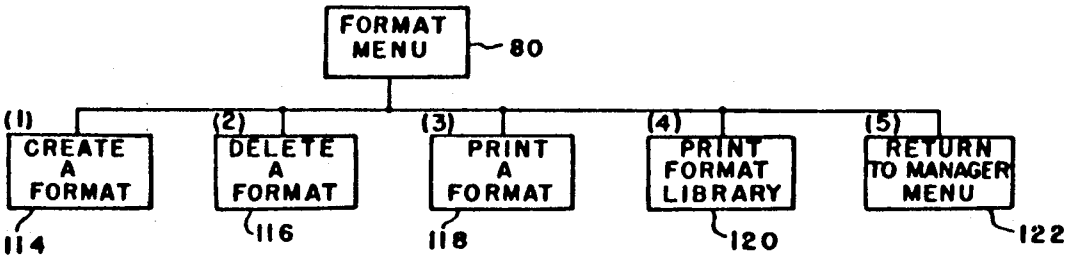
FIG. 5 is a pictorial representation of the submenu for the FORMAT routine which can be selected from the MANAGER menu illustrated in FIG. 3.

Setting the game format routine 78 produces a separate submenu illustrated in FIG. 5 from which a number of operations may be chosen. The operator or game scheduler may choose to create a format by selecting routine 114, delete a format by selecting routine 116, or print a copy of a selected format by routine 118. Further, the entire format library can be printed by the selection of routine 120. Finally, from the format menu routine 80, the operator has the choice of returning to the MANAGER menu 52 by selecting the choice illustrated in block 122. FIG. 17 shows an example of a win format which was created with the routine 114 and then printed by routine 118.

Figure 4:
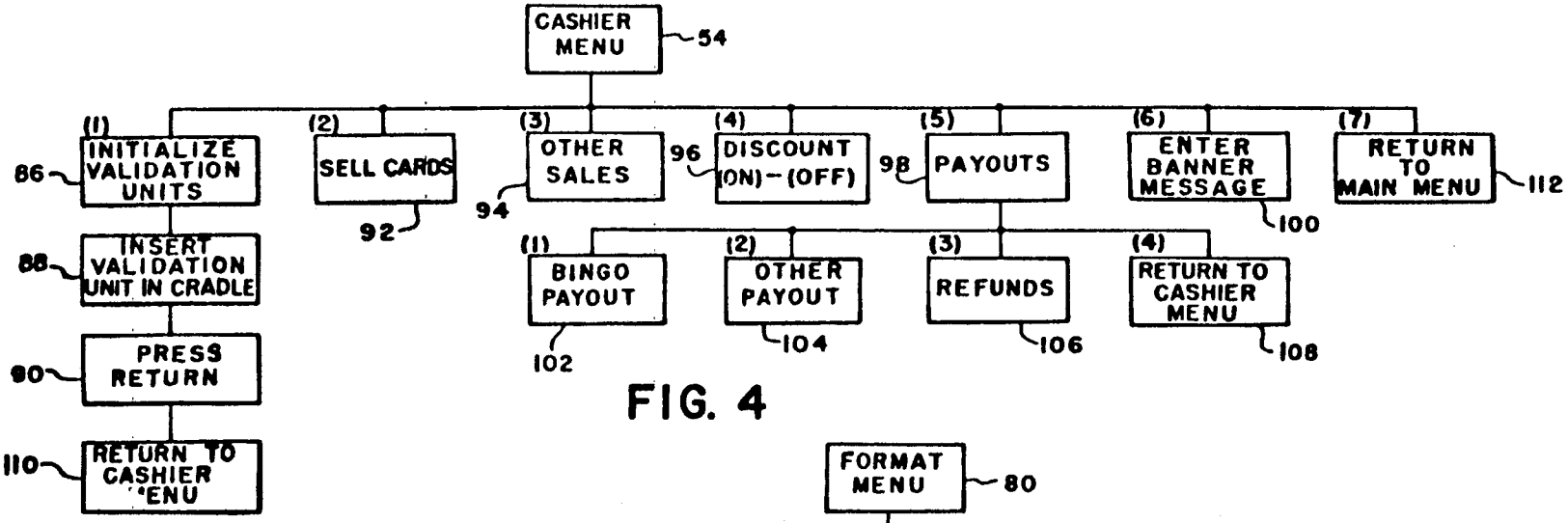
FIG. 4 is a pictorial representation of the menu of the CASHIER routine which can be selected from the MAIN menu illustrated in FIG. 2.

After the operator has accomplished all of the functions that are necessary for his particular establishment and gaming session in manager mode, he can return to the MAIN menu by selecting the choice of routine in block 84. Once back in the MAIN menu the system base station 10 is ready to begin the gaming session which may or may not begin immediately. When it is desired to start the gaming session, the MAIN menu 52 is entered by the correct password and the cashier mode 54 is selected. The selection of the cashier mode 54 causes a CASHIER menu illustrated in FIG. 4 to be displayed on the monitor 18.

The CASHIER menu allows for the initialization of the validation units 14 by selecting the beginning of a routine 86. This selection causes the operator to be prompted with a message to insert a validation unit 14 in the communications cradle 24 of the system base station 10 in block 88. When the operator has finished the insertion step, he will press a carriage return in block 90 and the system will automatically initialize the validation unit 14 with the data previously described. After the routine 86 has successfully completed the initialization, the program will return to the cashier menu in block 110. This program is repeated if any other validation units 14 are present and need to be initialized.

The number of validation units 14 will be proportional to the number of gaming cards sold during a particular gaming session. Therefore, the validation units 14 may be initialized in a group before the start of the gaming session if the average number of players is known. Alternatively, a validation unit 14 may be initialized at any time during the gaming session when it becomes apparent that that more cards are being sold then was originally anticipated.

If the second selection on the cashier menu 54 is taken, then a routine to sell the cards is entered. The card sale routine 92 consists of a prompt to the operator to insert one of the uninitialized electronic gaming boards 12 into the communications cradle 24. The particular board is assigned the next serial number beginning with a particular offset and the operator is then prompted to input the number of regular cards which the player has purchased. The operator then enters a number from 0–40 or none. After the response, the program then prompts with a request to enter the number of special cards purchased. After the operator has responded to this, he must also input the number of instant bingos that the player has purchased. The last input that the operator makes is the number of chances that the player has to produce an instant bingo. Once all the information has been loaded into the system and formatted into the correct data blocks, the operator will press the carriage return and cause the system base station 10 to down load the gaming schedule that was developed during the manager mode 52 and the game parameters which were input during selling of the card.

After the successful loading of a gaming board 12, the player is given the board to load with numbers of the arrays he has purchased and a printed receipt of the transaction. An example of a printed receipt showing the purchase during routine 92 is illustrated in FIG. 11.

A routine 94 may be selected to manage other sales and a routine 96 selected to determine whether a discount should be given for any purchases. The selection of a routine 100 allows the operator to enter a message into a special storage area of the system base station 10. When the players receive their receipts from the sales of the cards, such message will be preprinted thereon as a banner or header advertisement such as on FIG. 11. Further, the CASHIER menu 54 allows for a selection in block 112 to permit the operator to return to the main menu 50. The last selection of the CASHIER menu 54 is a payout routine 98. The payout routine 98, when selected, causes a submenu having four choices to be displayed on the monitor 18 of the system base station. The selections of the PAYOUT menu 98 include whether the payout is a bingo payout 102, another payout 104, or a refund 106. One last selection allows the operator to return to the CASHIER menu in block 108.

Figure 6:
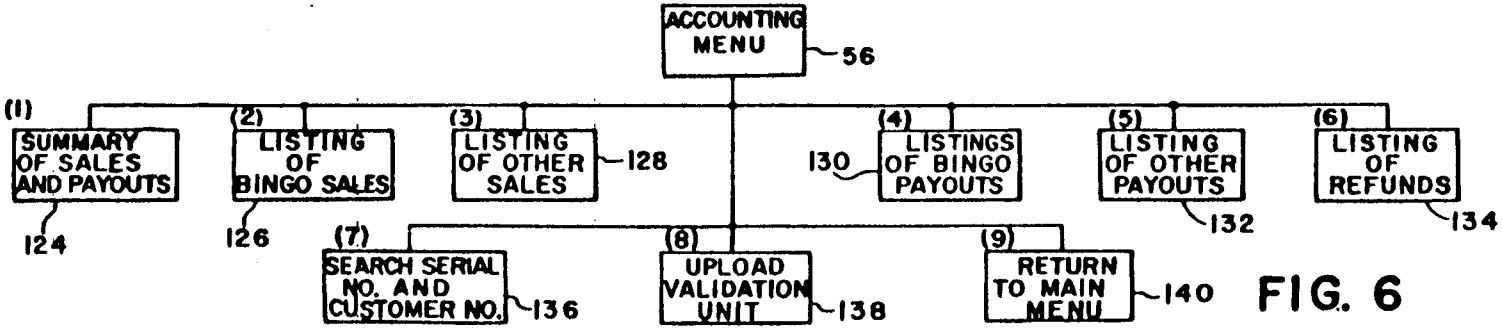
FIG. 6 is a pictorial representation of a menu for the ACCOUNTING routine which can be selected from the MAIN menu illustrated in FIG. 2.

After the gaming session has been completed and the validation units 14 have been collected, the operator will cause the program to branch back to the MAIN menu 50 (FIG. 2) where the ACCOUNTING routine 56 is selected. FIG. 6 illustrates a detailed menu displayed on the monitor 18 of the system base station 10 when the ACCOUNTING routine 56 is selected from the main menu 50. The accounting menu 56 allows the listing of a number of system parameters on the display screen or alternatively their printout on a paper tape printer 20. The system base station 10 has been collecting data from all of the sales, payouts, and refunds of the gaming session. The stored information concerning the entire gaming session dynamics is condensed and compressed into a formatted output. A listing of the bingo sales may be obtained by selecting routine 126 or a listing of other sales may be obtained by requesting routine 128. Further, the listings of the bingo payouts or the other payouts may be obtained by requesting either selections for routines 130, 132, respectively. In addition, a listing of all refunds may be obtained by selecting block 134 from the ACCOUNTING menu 56. A summary of all of the sales and payouts can be collectively obtained by selecting the routine 124. This routine gives a listing of the sum total of all sales in a category type rather than individual listings as routines 126–134 accomplish. An example of a summarY report is shown in FIG. 12.

To obtain actual support information for these audit functions from the validation units 14, a routine 138 is selected and executed. The upload validation routine causes a prompt to be displayed on the monitor 18 of the system base station 10 indicating that the validation unit 14 should be connected to the communications cradle 24. After the connection task has been accomplished by the operator, he will press the carriage return key and the system base station 10 will automatically interrogate the validation unit 14 to cause an upload of the audit information contained therein. Once the audit information has been extracted from the validation unit 14, the command which causes the validation unit 14 to the powered down is generated by the system base station 10. This operation turns the validation unit 14 off during those times when the gaming session is not being played.

Routine 136 of the ACCOUNTING menu 56 provides a search serial number and customer number routine which can be selected. This routine permits the system to do a global record search of all the audit information that it has stored for a particular serial number or customer number which is entered by the operator. This operation is for checking purposes and allows the operator to quickly find a record if there is some discrepancy between sales, payouts, refunds. The last selection 140 in the ACCOUNTING menu allows the operator to return to the main menu.

Figure 19:
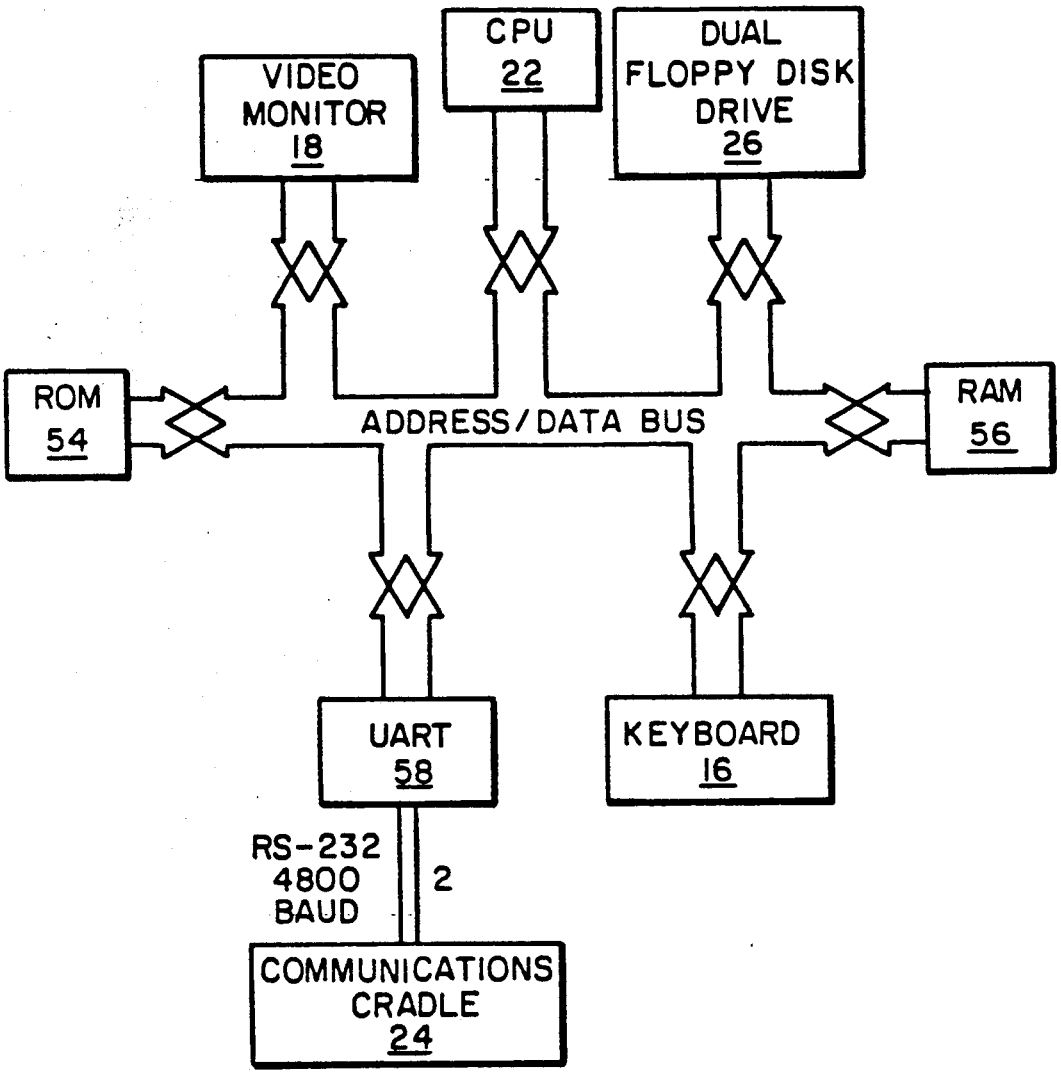
FIG. 19 is a block diagram of the system base station used in the system shown in FIG. 1.

As best shown in FIG. 19, the system base station 10 includes a video monitor 18, a central processing unit (CPU) 22, a dual floppy disk drive 26, read-only memory (ROM) 54, random-access memory (RAM) 56, a keyboard 16, a universal asynchronous receiver transmitter (UART) 58, and a communications cradle 24. These devices are configured as a data processing system.

The system base station 10 is microprocessor-controlled, functioning as a point-of-sale terminal and accounting center. The system base station 10 uses the communications cradle unit 24 to interface with any of the electronic gaming boards 12 or any of the validation units 14 such that data can be transferred between the devices. The electronic gaming boards 12 are used by respective players in place of physical paper cards and markers which traditionally have been used in the game of bingo.

The system base station 10 stores data in the dual floppy disk drive 26, the ROM 54, and the RAM 56. The dual floppy disk drive stores a library of gaming cards comprised of a plurality of individual game card arrays. ROM 54 stores the gaming board instructions which direct the gaming boards 12 to store the game card arrays in the appropriate areas of gaming board memory. The RAM 56, in conjunction with the CPU 22, assembles a base station program which contains game card arrays as well as the gaming board instructions.

The library of gaming cards may be produced by means of a predetermined algorithm. Such an algorithm should eliminate the possibility of generating two identical game card arrays. However, the algorithm must preferably meet a more stringent requirement. It is critical to note that the individual game card arrays are stored in the gaming card library as a sequence of records, and that these records are then downloaded sequentially into the gaming boards 12, one gaming board at a time. Therefore, a game player who purchases several game card arrays will obtain a set of arrays which are stored at adjacent locations in the gaming card library. If the predetermined algorithm generates a sequence of gaming card arrays such that substantial similarities exist between any two adjacent arrays, the game player could end up purchasing 40 gaming cards which are virtually identical. Granted, one or two numbers in each of these 40 arrays may be different, but the player may justifiably feel as if he is essentially playing the same card 40 times over. Therefore, the algorithm should ensure that there are substantial differences between arrays situated at adjacent records within the gaming card library.

Another method of producing the gaming card library is to use a random number generator. However, the operator should ensure that no two game card arrays are identical prior to their inclusion in the gaming card library. Such a procedure may prove time-consuming. However, the random number generator method avoids a problem inherent with many predetermined algorithms in the context of the present embodiment. Use of a random number generator is likely to result in adjacent game card arrays which differ substantially from one another. Thus, sequential downloading of the game card arrays from the gaming card library will provide the game player who purchases multiple cards with substantially different arrays.

The system base station 10 may be employed to create the gaming card library, regardless of which production method is chosen. Since the system base station 10 is a microprocessor-based disk operating system capable of running interactive applications routines, receiving operator inputs, and processing data, the base station 10 is capable of executing a wide range of commonly-available routines and algorithms for generating random or quasi-random numbers.

Once the array numbers for the gaming card library are generated, these numbers are transferred to memory within the disk drive 26. As will be described in more detail hereinafter, each individual game card array is stored within 12 bytes. Therefore, a typical floppy disk which holds 300,000 bytes of storage space will be able to accommodate 300,000 bytes divided by 12 bytes per record, or 25,000 individual game card arrays. Since each gaming board 12 can store up to 40 game card arrays, a gaming card library consisting of one or two floppy disks is likely to satisfy most any system application.

Figure 20:
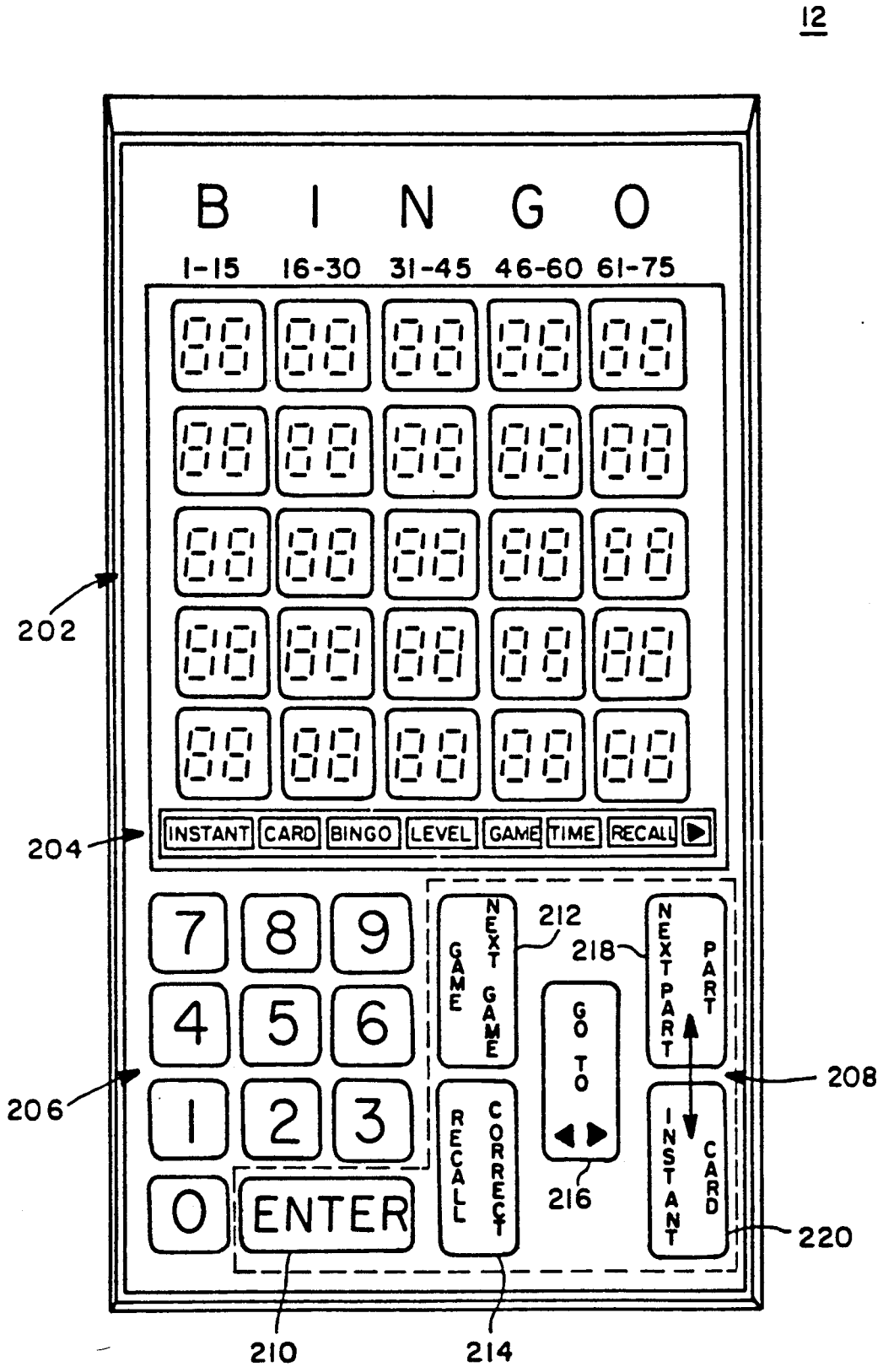
FIG. 20 is a plan view of the electronic gaming board illustrated in FIG. 1.

FIG. 20 depicts a plan view of the electronic gaming board handset 12. The gaming board 12 is essentially divided into four main sections. First, there is a liquid crystal display (LCD) section 202 with 25 array symbol display spaces, each having two 7-segment digital displays. Preferably, the display is in the form of a 5×5 array of rows and columns which can be used to display the numbers of a bingo card, as well as other types of information. The second section 204 is an LCD annunciator bar divided into a plurality of status and mode indicators. The annunciators indicate schedule status, i.e., the game, card, and level numbers of the game presently in play. Three additional annunciators indicate gaming board mode, i.e. instant bingo mode, recall called numbers mode, and bingo mode. A go to (arrow) annunciator 216 indicates a transfer or shift to special functions.

The third section of the gaming board 12 is a decimal membrane-type key pad 206 for entering digits 0–9 into the board. The fourth section 208 allows the player to operate the gaming board 12 by providing a plurality of membrane-type function keys. In this particular gaming board 12, there are six function keys, providing the player with convenient board operation. The six function keys are:

| | |
|---|---|
| Enter | 210 |
| Game (Next Game) | 212 |
| Recall (Correct) | 214 |
| Go To or Shift | 216 |
| Part (Next Part) | 218 |
| Card (Instant) | 220 |

The parenthetical functions of the keys 212, 214, 218 and 220 are reached through the sequence of first pressing the shift key 216 and then the desired operation. Normal function is obtained for each key 212, 214, 218, and 220 by direct operation.

The four sections of the gaming board including the display 202, annunciator bar 204, numeric key pad 206 and function keys 208 provide for the facile playing of a complex gaming schedule without the player's enduring a long familiarization process. A player can easily execute or play a substantial bingo schedule comprising up to 16 independent games with up to four levels or four places per game. For each of the independent games, a player may play up to 40 cards automatically with ease and without any worry that a winning bingo may not be noticed.

Each game, level or place may contain an arbitrary win pattern which is automatically recognized from the stored gaming schedule. For example, to win the first level of a bingo game, a player might be required to achieve a win pattern consisting of all four corners on a card. The second level might require a player to achieve a win pattern comprising a large square, wherein the entire "B" column, the entire "O" column, the uppermost row, and the lowest row must all be marked. A third level could then require that the entire card be marked.

The electronic gaming boards 12 are in a communications mode when connected by a cable 30 to either the system base station 10 or a validation unit 14; during a gaming session, the electronic gaming boards are in a play mode. The communications mode interrupts the play mode at any time by connection of the gaming board 12 to one of the external units.

In the communications mode, a gaming board 12 is downloaded with game information, such as a gaming schedule, microprocessor instructions, and one or more bingo card arrays 44. Bingo card arrays for up to 40 games are provided in a string of 1025 bytes which is initially sent, byte-by-byte, to a temporary storage area within the external RAM 812 of the gaming board 12. Once the string is loaded into external RAM 812, the gaming board 12 is automatically set to the play mode upon disconnection of the cable 30.

Play of a bingo game in a session is commenced when a player presses a two-digit number on the key pad 206 and then presses the Enter key 210. This two-digit number is that randomly selected and announced by the caller. The gaming board 12 searches its working storage area 814 corresponding to all of the enabled game cards and marks each match found. On the bingo card array currently displayed, the corresponding square or space is blanked. For other card arrays stored, but not displayed, the match is similarly noted. If a particular win pattern for any card 52 stored in memory is completed by the match, then the gaming board 12 will signal a win indication by displaying the bingo annunciator and by playing an audible tune.

The function keys 212, 214, 218 and 220 are used in combination with the annunciator bar 204 and center space of the display 202 to provide downloaded game schedule information to a player. For example, by pressing the Game key 212 the player will display the game annunciator and the number of the present game of the schedule in the center (free) space as long as the key is held down. Likewise, pressing the Part key 218 will display the level annunciator, and the level number for the present game will be displayed in the center space.

Pressing the Recall key 214 will cause the display to reverse itself, blanking out all numbers except those that have been marked or matched for the particular card being displayed. Those marked numbers are now displayed as they were originally, while all others in the array are blank. This allows a player to recall which numbers have been matched on a card. The recalled numbers are displayed along with the recall annunciator as long as the Recall key 214 is depressed. In a similar manner, pressing the Card key 220 displays the card annunciator, and the number of the present card will be displayed in the center space. These two indicators will be displayed for as long as the Card key is held.

The function keys 212, 214, 218 and 220 also relate to alternative functions which, in combination with the Shift key 216, provide special operations. Selection of the Shift key 216 displays the arrow annunciator and cautions the player that the next function key pressed, 212, 214, 218 or 220, will create a special operation. The Shift key 216 in combination with the Next Game key 212 causes the gaming board 12 to proceed to the next game in the sequence of the gaming schedule. The sequence of the Shift key 216 and the Next Part key 218 allows a player to move between levels or parts of an individual game. The Shift key 216 selected prior to the Instant key 220 allows the player to display different cards in the sequence of stored cards. The Instant key 220 pressed during the play mode has the function of changing the cards in the display; if it is pressed prior to the game mode, it will produce an instant game function described more fully hereinafter.

Figure 21:
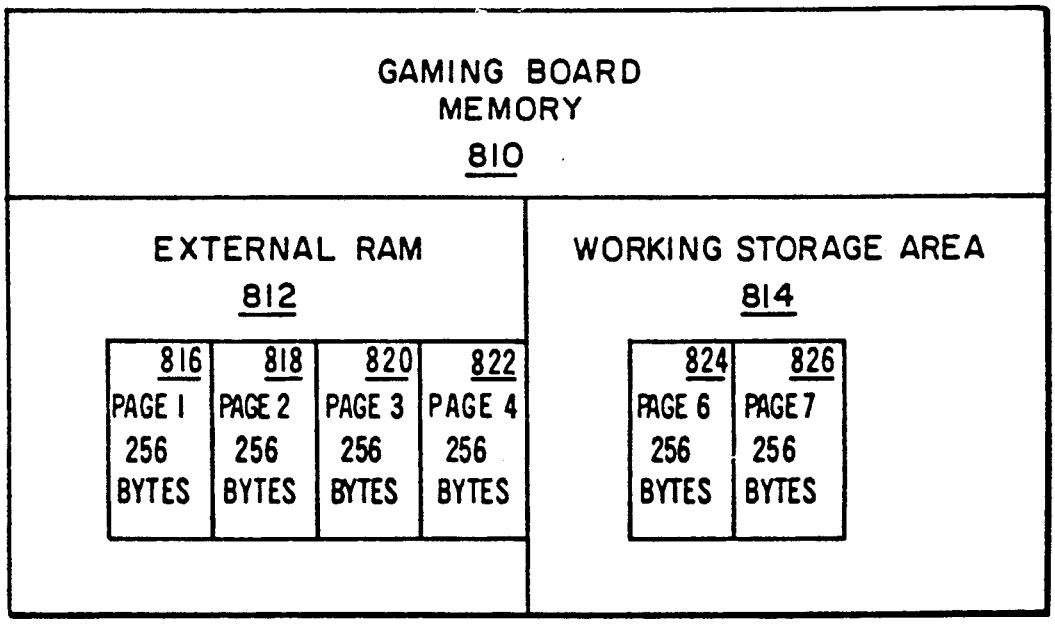
FIG. 21 is a block diagram depicting the organization of memory into external RAM and working storage areas for the electronic gaming board illustrated in FIG. 1.

The organization of gaming board memory 810 is depicted in FIG. 21. Memory 810 is divided into External RAM 812 and the Working Storage Area 814. External RAM 812 includes pages one through four, 816, 818, 820, and 822. The Working Storage Area includes pages 6 and 7, 824 and 826. Each individual page contains 256 bytes. Pages 1 and 2, 816 and 818, will store gaming board instructions which are downloaded from the system base station. Pages 3 and 4, 820 and 822, will temporarily store the individual game card arrays 52 downloaded from the game card array library 62, until these individual game card arrays are transferred to Pages 6 and 7, 824 and 826, of the Working Storage Area 814.

In general, each electronic gaming board 12 is connected through the cradle 24 to the system base station 10 during the communications mode. In the communications mode, the game schedule 66 is downloaded into gaming board memory 810. Next, the base station program 50, which includes at least one gaming card 52 in addition to the gaming board instructions 46, is downloaded from the system base station RAM 54 into the External RAM 812 of the individual gaming boards 12.

Figure 22A:
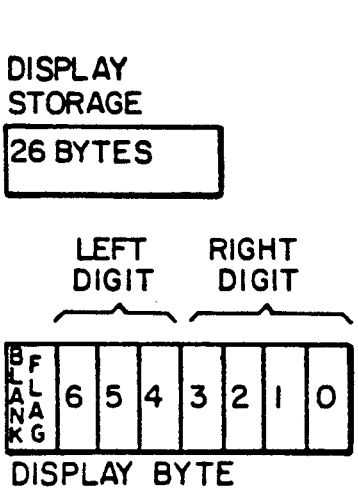
FIGS. 22A, 22B, 22C, and 22D are diagrammatic representations of storage areas used for various operations of the electronic gaming board illustrated in FIG. 1.

FIGS. 22A, 22B, 22C and 22D illustrate a number of storage areas in the memory of the gaming board 12 which assist with the functions previously described. FIG. 22A illustrates that an area of memory termed display storage contains 26 bytes. This storage area represents the 25 spaces of the display array 202 and the annunciator bar 204, shown in FIG. 20. Each display byte which corresponds to a space contains the two digits of that display space in the first 7 bits and a blank flag in bit 8. As matches take place, the flag bits are set so that when the particular card which is stored in the display storage is shown, the numbers which have been called are blanked. By contrast, when a recall function is requested, the spaces which are not flagged are blanked by the display.

Figure 22B:
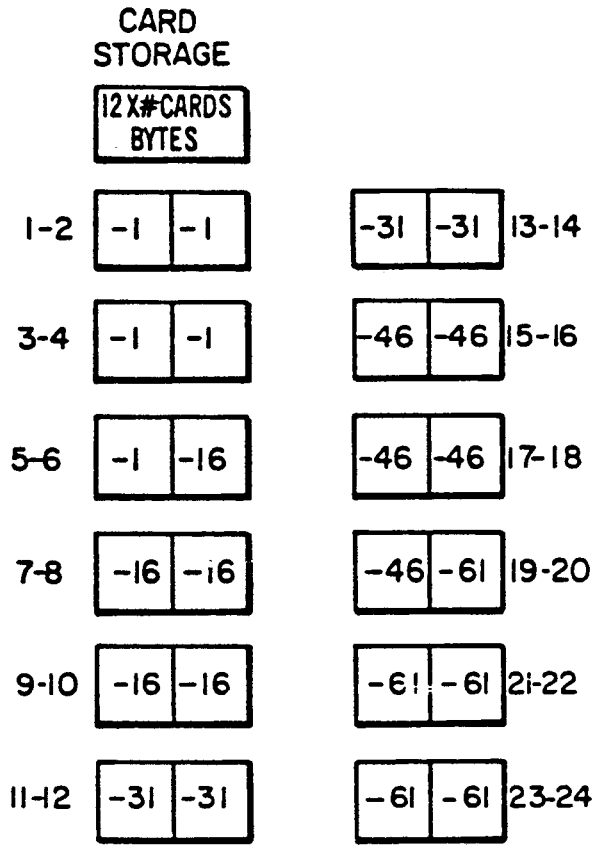

With reference to FIG. 21, there is a storage area termed card storage, located in the Working Storage Area 814, which stores the numbers for all of the individual game card arrays 52 purchased and downloaded from the system base station 10. The card storage is illustrated in FIG. 22B, and comprises 480 bytes (12 bytes×40 cards). If fewer than 40 cards are played, the remaining bytes are valued at binary zero. Each number for a space selected in a card is stored in one nibble of a byte. An entire card of 24 numbers is downloaded and stored in 12 bytes by a reduction algorithm which reduces each number to four bits in length. All numbers of a particular column of a bingo card can have one of fifteen values. The position of the column determines an offset which can be added to the numbers 1–15 which will yield all fifteen values. The binary equivalent for 1–15 can be stored in 4 bits. Therefore, once a card is loaded in the display storage, it is reduced to twelve bytes by subtracting a column-dependent offset from each number prior to its storage in card memory. The reverse is true when the card array is to be displayed, such that a position-dependent offset is added to each number when loading the display storage from the card memory. As shown in FIG. 22B, the offset is 1 for the first column, 16 for the second, 31 for the third, 46 for the fourth, and 61 for the fifth. The numbers shown in the boxes are subtracted from the bingo numbers to give 4-bit numbers suitable for storage.

Figure 22C:
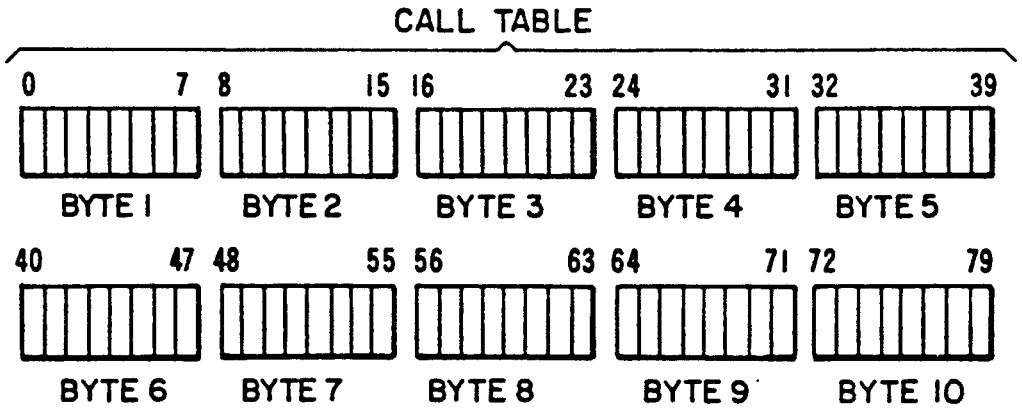

As play progresses and the player enters numbers into the gaming board 12, these numbers must be remembered to determine duplicate entries, and for validation purposes. The gaming board 12 stores the called numbers in an area termed the call table 53, which is illustrated in FIG. 22C. The numbers are stored in a plurality of sequential bytes having at least one bit for each possible number. In the illustrated example, 75 bits are arranged in 10 bytes of RAM where bit 0 in the first byte is not used, bit 1 of the first byte represents the numeral 1, bit 2 in the first byte represents the numeral 2, bit 3 in the first byte represents the numeral 3, and so on. Then, bit 0 in byte 2 represents the numeral 8, and so on.

Figure 22D:
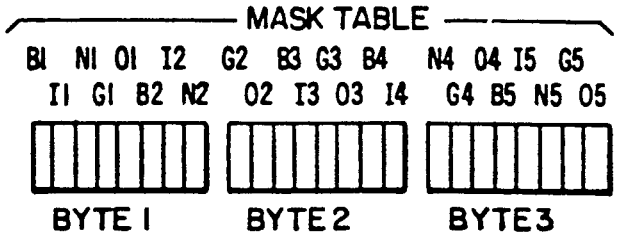

For each card array, the pattern of spaces on the display can be represented, as discussed previously, by 24 bytes, one for each space except the free space. A mask for each enabled card representing the numbers called is stored in an area termed the mask table 51 as illustrated in FIG. 22D. Bit 0 of the first byte of a mask represents space B1 of a card; bit 1, space I1; bit 2 , space N1, etc.

Each time a number is entered into the gaming board 12 during the play mode, the board searches all enabled cards to determine if there is a winning bingo. The mask for each card is checked against all win patterns in the current format, as indicated by the schedule determining the game and level being played. If the display mask contains all the blank positions indicated by one of the win patterns, it is a potential bingo. If not, the search proceeds to the next card until all cards have been checked against all patterns in the current format. When the search is complete, the card which was displayed when the call was entered is redisplayed, and the board waits for another entry.

Figure 23:
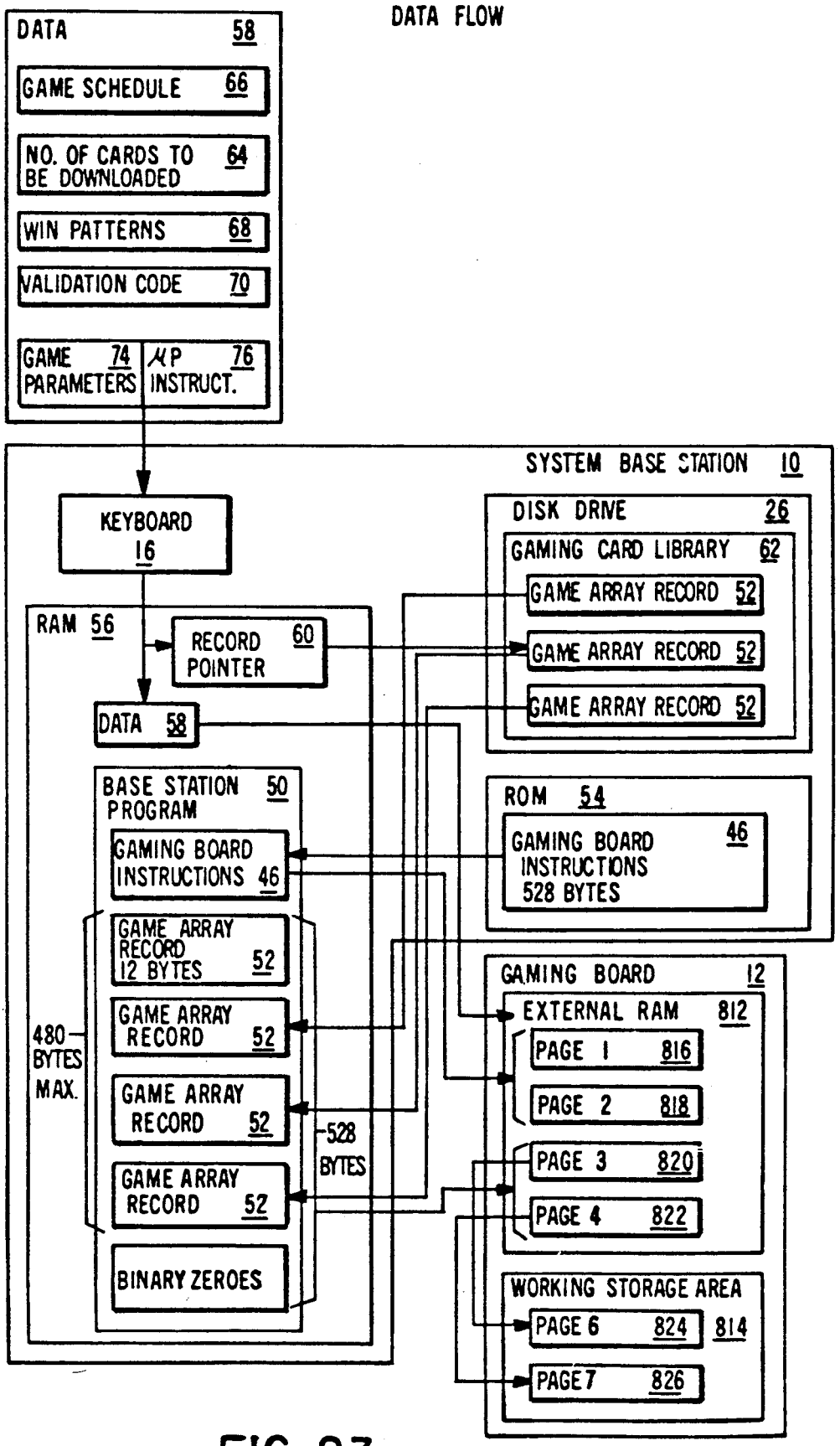
FIG. 23 is a block diagram which illustrates data transfer between the user, the system base station RAM shown in FIG. 19, the system base station ROM shown in FIG. 19, the system base station dual disk drive shown in FIG. 1, and the gaming board external RAM shown in FIG. 21.

FIG. 23 illustrates the transfers of data which take place when individual game card arrays are to be downloaded from the system base station 10 into the gaming boards 12. The user enters game data 58 into the keyboard 16. This game data 58 includes the number of game cards, from 1 to 40, to be downloaded 64; the game schedule 66, which consists of a plurality of win patterns 68 and the order in which these win patterns are to be played; a validation code 70 specific to a particular gaming session, and an assignment code 72 specific to one individual gaming board 12. The game data 58 is transferred from the keyboard 16 to the system base station RAM 56. The base station CPU 22 refers to the number of cards to be downloaded 64 when updating the value of a record pointer 60 stored within the base station RAM 56. The record pointer 60 points to an individual game array record 52 located within the game card array library 62.

The individual game array records 52 are stored in a random-access file comprising a game card array library 62, on the dual floppy disk drive 26 of the system base station 10. Each individual game card array 52 is stored as a single record in the file with the record number used as the serial, or library, number of the card face. For instance, library card number 1079 means that its card array data is the 1079th record in the game card array library 62.

Although a bingo card contains 24 two-digit numbers ranging from 1 to 75 (or 1 to 90), it is possible to pack an individual bingo card array 52 into only 12 bytes, or two hexadecimal digits. This packing operation is accomplished by recognizing that each column of a bingo card consists only of the possible numbers 1 to 15 plus a constant offset. Thus, the "B" column will only have numbers 1 through 15; the "I" column will only have numbers 16 through 30, or numbers 1 to 15 if a constant offset of 15 is added; the "N" column will only have numbers 31 through 45, or numbers 1 through 15 if a constant offset of 30 is added; the "G" column will only have numbers 46 through 60, or numbers 1 through 15 if a constant offset of 45 is added; and, finally, the "O" column will only have numbers 61 through 75, or numbers 1 through 15 if a constant offset of 60 is added. Thus, by organizing the numbers into columns and subtracting the appropriate offset for each column, all the numbers on a bingo card can be reduced to a number between 1 and 15 and thus represented as a hexadecimal digit. Since each byte holds two hexadecimal digits, an entire game card array can be stored in 12 bytes.

In this manner, approximately 50,000 individual game card array records 52 can be stored in a file, or a game card array library 62, containing 50,000 records, each 12 bytes long. The game card array library will be 12 bytes times 50,000 records long, for a total of 600,000 bytes. Therefore, the game card array library 62 will easily fit on a hard disk drive. Alternatively, the game card array library 62 will fit on two floppy disks as two files of 300,000 bytes each. However, if floppy disks are used, the library card numbers for game card array records 52 beyond the first file, or disk, must be adjusted by the number of cards on the first disk to give the proper record number for that card face on the second disk.

When a game card array 52 is to be displayed on the game board 12, the game card array 52 must be unpacked. Unpacking is merely the reverse of the packing operation. Each hexadecimal digit is converted to decimal and the offset appropriate to the column of the number is added, thus restoring the original bingo card numbers.

The procedure of downloading individual game card arrays 52 from the game card array library 62 into the gaming boards 12 commences when the system base station operator enters the appropriate command into the keyboard 16. The system base station CPU 22 responds by forming a base station program 50 in the base station RAM 56. The base station program 50 is a sequence, or string, of bytes that is 1024 bytes long. The first 528 bytes are reserved for the gaming board instructions 46, which are retrieved from the system base station ROM 54, the system base station RAM 56, or the disk drive 26. The gaming board instructions order the gaming board 12 to move the game card array records 52 from Pages 3 and 4, 820 and 822, of External RAM 812 to Pages 6 and 7, 824 and 826, of the Working Storage Area 814. If the gaming board instructions 46 do not require the full 528 bytes allocated, the remaining bytes are filled with binary zeroes.

The system base station CPU 22 next loads the individual game card arrays 52 into the base station program 50. The base station CPU 22 refers to the number of cards to be downloaded 64, as entered by the user, to update the value of the record pointer 60 stored within the base station RAM 56. The record pointer 60 points to an individual game array record 52 located within the game card array library 62. Knowing the starting library card number from the initial value of the record pointer 60, and knowing the number of cards 64 to be downloaded from the game card array library 62, the base station CPU 22 sequentially reads the 12-byte game array records 52 from the game card array library 62. The base station CPU 22 then adds these game array records 52 to the base station program starting at the 529th location. Since up to 40 game array records may be downloaded into each gaming board 12, then up to 40 times 12 bytes, or 480 bytes, can be transferred into the base station program 50. From the end of the card data, the base station program 50 is completed to 1024 bytes by filling in the remaining bytes with binary zeroes.

Note that the packed representations of the game card arrays are stored in the base station program 50, and the library card numbers of the individual game card arrays 52 are sequential. Furthermore, the initial value of the record pointer 60 is stored in the base station RAM 56. Since the initial value of the record pointer 60 contains the starting library card number, and the individual game card arrays 52 are downloaded sequentially, each individual game card array 52 may be positively identified.

Once the base station program 50 is assembled in the base station RAM 54, an ASCII character, "3", is added to the front of the 1024-byte string. This character instructs the gaming board 12 that a base station program 50 is to follow, and that the program should be loaded into External RAM 812, starting at Page 1 (818) and ending at Page 4 (824), each page being 256 bytes long.

Next, the base station CPU 22 sends an interrupt signal to the gaming board 12. This interrupt signal causes the gaming board 12 to stop whatever it is doing and enter the communications mode. The base station program 50 is then transmitted from the system base station 10 to the gaming board 12 based upon the RS-232 serial communications standard. A transmission rate of 4800 baud is used, with the appropriate start and stop bits around each character. As the gaming board 12 receives each byte, it adds the byte to a running checksum. After a complete 1024-byte base station program 50 has been received, the gaming board 12 sends the checksum to the base station 10. The base station CPU 22 compares the checksum received from the gaming board 12 against a checksum the CPU 22 calculated to see if the transmission was successful.

The system base station 10 also downloads the validation code 70, game parameters 74, and optional microprocessor instructions 76 for execution. While downloading, the system base station CPU 22 notes and records in RAM 54 the game card library numbers of those game cards 52 which have been distributed to the gaming boards 12.

The validation code 70 is a unique number corresponding to one specific gaming session. This code ensures that the dishonest player will not win on a game card purchased for use in another game session or at another game location.

Once the communications are completed, the gaming board 12 microprocessor returns to the point in its control program where it left off before receiving the interrupt from the system base station 10. One of the periodic operations in the gaming board 12 control program is to call the subroutine on the first page of External RAM 816. Normally, there is only a "RETURN" command at this location which sends the gaming board 12 microprocessor back to the control program. But after the aforementioned downloading procedure, the gaming board instructions 46 are at this location and will be executed periodically, every time the subroutine call is made. To avoid repeated executions, these instructions contain a final command. Once the instructions have been executed for the first time, the final command orders the gaming board 12 microprocessor to place a "RETURN" instruction at the beginning of Page 1. Thus, the gaming board instructions 46 will be executed only once for each downloading operation.

Note that the individual game card arrays 52 are stored in the Working Storage Area 814 of the gaming board memory 810 in packed form. The individual game card arrays 52 are unpacked only when the gaming board 12 copies an individual game card array 52 to the display RAM area.

The process of downloading the bingo card arrays 44 into external RAM 812 before moving the information into the working storage area 814 can be replaced by a more efficient process which directly loads the bingo card arrays 44 into the working storage area 814. This more efficient process could be implemented by changing the program code of the gaming board 12. However, the program code was fixed into the gaming boards 12 before the present downloading procedure was conceived. The fixed program code of the gaming board 12 expects to find the bingo card arrays 44 stored within the working storage area 814, not the external RAM 812, thus mandating a two-step downloading procedure.

When the ROM program code of the gaming board microprocessor 300 is changed, it will be possible to have the bingo card arrays 44 sent directly to the working storage area 814 as the base station program 50 is received. This would eliminate the need for downloading the gaming board instructions 46. Furthermore, the bingo card arrays 44 would no longer need to be stored temporarily in the external RAM 812.

After this expeditious downloading procedure, the gaming board 12 enters the play mode where the random numbers called by the operator are matched against numbers in the respective bingo card arrays 44. As the numbers of a particular game are called, the player enters those numbers into his electronic gaming board 12 to determine if they match any of the numbers on one of the bingo cards 52 contained therein. A particular game in the session is played until one of more of the electronic gaming boards 12 signals, audibly and by a visual indicator, that the game has been won. A payout is made using the validation units 14 and play is resumed until an entire gaming schedule is completed.

The validation units 14 are initialized by connection to the cradle 24 of the system base station 10 and receive an assignment code and the validation code for the particular gaming session. When a player scores a bingo, or other type of winning combination, the validation units 14 are used to verify that the win was legitimate. At the same time, information specific to a win is recorded within the validation unit 14 and later these stored data records, along with a validation unit identification code, are uploaded to the system base station 12 via the cradle 24.

Figure 24:
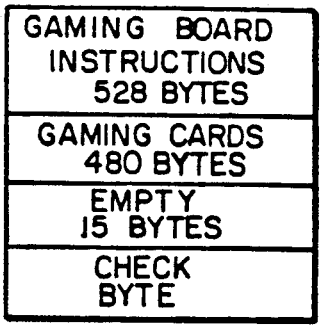
FIG. 24 is a diagrammatic representation of the data packages which are transferred between an electronic gaming board and the system base station or validation unit shown in FIG. 19.

The system base station 10 can download a data block, such as a system base station program 50, through the communications interface to a respective gaming board 12 as illustrated in FIG. 24. The program 50 consists of an ASCII 3 followed by a string of 1024 bytes. The first 528 bytes contain gaming board instructions 46 which are used by the gaming board 12 to move data from temporary storage in External RAM 812 to the Working Storage Area 814. The next 480 bytes are devoted to individual game card array 52 storage. As each individual game card array 52 is represented with 12 bytes, 480 bytes allows for for 40 game card arrays. The string is completed to 1023 bytes with binary zeroes, and the final byte is reserved as a check byte.

Figure 25:
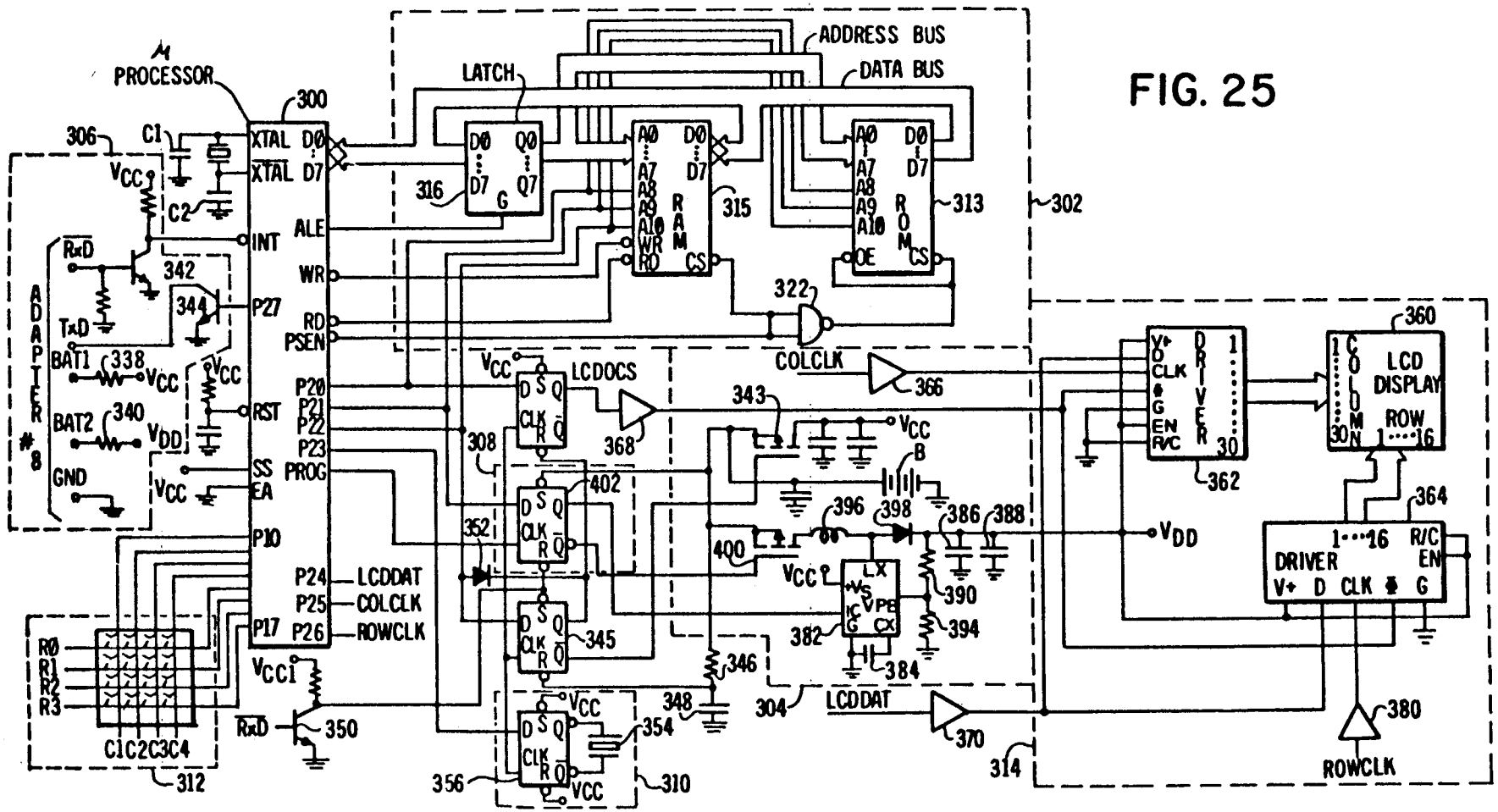
FIG. 25 is an electrical schematic diagram of the circuitry comprising the electronic gaming board illustrated in FIG. 20.

FIG. 25 illustrates a detailed electronic schematic of a gaming board 12 which generally comprises a microprocessor 300, a memory and memory control circuit 302, a power supply 304, a communication interface 306, a power bistable 308, an audio annunciator 310, a keyboard 312, and display and display driver units 314.

The microprocessor 300 is a standard, single-chip microcomputer having a bidirectional data/address bus D0–D7, bidirectional input and output ports P10–P17, P20–P27, and I/O control lines WR, RD, PSEN, and PROG. Further, the microprocessor 300 has pins for handling interrupts INT and resets RST. While the microprocessor 300 could be any of a number of single-chip microcomputers, preferably the device is an 80C49 microprocessor manufactured by the Intel Corporation of Santa Clara, Calif. The pin designations shown will pertain to that device and are more fully described in the operating manual for the Intel 80C49. A single-chip microcomputer of this type includes a central processing unit, 128 bytes of random-access memory (RAM) and 16 8-bit registers R0–R15. Further included are provisions for an 8-word by 16-bit memory stack, 96 bytes of general-purpose RAM and, as an option, 2 kilobytes of read-only memory (ROM).

Communications for the microprocessor 300 with peripheral devices are carried out through the 8-bit data/address bus D0–D7, and the I/O control lines. A 6-MHz crystal Y1, connected between terminals XTAL and *XTAL of microprocessor 300, serves as a frequency reference for an oscillator circuit located within the microprocessor 300. Each terminal of the crystal Y1 is further connected to a capacitor, one crystal terminal connecting to C1, and the other crystal terminal connecting to C2. The remaining terminals of capacitors C1 and C2 are grounded. The external access pin EA and the single step pin SS for the microprocessor 300 are not used and, therefore, are tied to ground and a high logic level Vcc, respectively.

Normally, a read-only memory 313 of the memory and memory control circuit 302 will contain the control program for the microprocessor 300. Instructions are transferred from the ROM 313 via its data output pins D0–D7 which are connected to the data bus and thereafter to the data ports D0–D7 of the microprocessor 300. The ROM 313 is accessed through the address bus and address lines A8, A9, and A10. An address byte from the data port pins D0–D7 is strobed into an address latch 316 with an alternate logic enable signal ALE. The data bus and the address bus are similarly utilized for the random-access memory 315. At the beginning of each memory cycle, the microprocessor 300 places the lowest 8 bits of a memory address on the data bus and then strobes them into the latch 316 with the ALE Signal. The high address bits A8–A10 are set by selection of logic levels on port pins P20–P22. For the remainder of the cycle, the data bus carries data from the RAM 315 or the ROM 313 to the microprocessor 300 or from the microprocessor 300 to the RAM 315.

Control for the direction of data flow, and the memory that data are taken from or written into, is controlled by the write control line WR, read control line RD, and the program sequence pin PSEN. These signals are connected with the control inputs of the random-access memory 315 and the read-only memory 313 via three memory control logic gates 318, 320 and 322 which have their outputs connected, respectively, to the read and chip select inputs RD, CS of the random-access memory 315, and to the output enable and chip select inputs OE, CS of the ROM 313. The write control line WR of the microprocessor 300 is also directly connected to the write input WR of the random access memory 315.

When the microprocessor 300 requests instructions or data from an external memory, it prepares the address bus, as described above, and pulls the signals PSEN, RD or WR, and PROG depending upon whether a read or write operation is to take place. Depending upon the state of the PSEN line, either RAM or ROM will be accessed. NAND gate 322 assures that RAM and ROM will never be accessed simultaneously.

With reference to FIGS. 1 and 25, the gaming board 12 communicates with two devices external to itself, namely the system base station 10 and the validation unit 14 through the communications interface 306 and the cable 30. The communication interface 306 is designed to consume an absolute minimum of power, particularly when idle, and to be reasonably fast. The communications interface 306 uses an asynchronous communications protocol with the addition of a special handshaking routine to establish communications. The general communications protocol is byte-serial communications with one start bit, eight data bits (no parity), and one stop bit at a data rate of 4800 baud. Serial data are transmitted via the transmit line Txd and received via the receive line Rxd.

When the gaming board 12 is connected to either the system base station 10 or the validation unit 14, the board acts as a slave unit and waits for the other device to initiate communications. The gaming board 12 uses the BAT1 signal generated through resistor 338 to signal the validation unit 14 of a connection with a high logic level. The gaming board 12 uses the BAT1 and BAT2 signals generated through resistors 338 and 340, respectively, to test for low battery voltage with the system base station 10 and the validation unit 14.

When the validation unit 14 or the system base station 10, as the case may be, detects the high logic level, it will establish a communications link with the gaming board 12. The link is achieved by the master device beginning the communications by placing a zero (break) signal 500 or 520 on the Rxd line of the gaming board 12, as shown in FIGS. 7A and 7B, respectively. With reference to FIG. 25, this break signal produces an interrupt to the microprocessor 300 by causing a transistor 342 to conduct. The gaming board 12 will then reply with a low-level response at 502 or 516 by applying a high logic level to the base of a transistor 344 through pin P27, thus grounding the Txd line through the transistor 344. The master unit will again respond by setting the Rxd output high at 504 or 520, removing the interrupt from the INT pin of the microprocessor 300. Thereafter, the microprocessor 300 will again reply at 506 or 517 by bringing the Txd line to a high logic level by turning off the transistor 344 with pin P27. Once the handshake has been accomplished, the link is established and data communications may take place.

The system base station 10 or the validation unit 14 will then transmit a one-byte command 522, 508, as shown in FIGS. 7A and 7B, respectively, to the gaming board 12, requesting a particular operation. Depending upon which device it is communicating with, the gaming board 12 will perform either a download operation as illustrated in FIG. 7A or an upload operation as illustrated in FIG. 7B.

The command byte is an ASCII numeral from the set [1, 2, 3, 4, 5, 6], specifying one of six commands as follows:

1 Download gaming schedule
2 Download game parameters
3 Download special instructions
4 Upload game parameters
5 Power down
6 Download game cards After receiving the command byte, the gaming board 12 executes one of the six commanded operations depending upon the value of the byte. If the command byte is a "1", "2", "3" or "6", the gaming board 12 prepares to receive (download) a block of data from the system base station 10. The downloaded data blocks have been discussed above in connection with FIGS. 10A, 10B, 10C and 24. If the command byte is a "4", the gaming board 12 will transmit (upload) a block of data to the validation unit 14. The uploaded data block has been previously illustrated with respect to FIG. 10D. If the command byte is a "5", the gaming board 12 will power down and turn itself off. Any other command byte value is ignored. After these actions are completed, the gaming board 12 breaks the communications link, thereby requiring the link to be re-established for further communication to occur.

Following the data block transfers, whether data went to or from the gaming board 12, a checksum byte is transmitted back to the master unit. The checksum is the arithmetic sum of all the bytes transmitted after the command byte. For data transmitted from the gaming board 12, the validation unit 14 must match the gaming board checksum to the checksum the validation unit calculated while receiving the data. If they match, the transfer was good and, if not, the validation unit 14 is responsible for re-establishing the link and reissuing the upload command until a good transfer is achieved. For data transmitted to the gaming card 12, the checksum must equal zero for a good data transfer, as a check byte will be included in each block of data to make the checksum equal to zero if the transfer is valid. Again, if the checksum transmitted to the system base station 10 is not zero, then it is incumbent upon the base station to re-establish the link and reissue the communications until a good transfer is achieved.

The power supply circuitry 304 and the power supply bistable 308 will now be more fully described with respect to FIG. 25. The gaming board 12 has no on/off switch. The gaming board 12 is turned off under program control and is turned on by the system base station 10 during initial communications. The main power switch for the gaming card 12 is a P-channel MOSFET 343 connected between a battery B and a voltage terminal Vcc. When the gate of the MOSFET 343 has a low logic level applied to it, the device provides a low-impedance path from the battery B to the terminal Vcc. When the gate has a high logic level applied to it, the MOSFET turns off, thereby shutting down most of the circuitry within the gaming board 12 and conserving battery power.

The gate of the MOSFET 343 is controlled by the output *Q of a power bistable 345. The bistable 345 is powered by the battery B directly and, therefore, operates whether the MOSFET 343 is on or off. When battery power is first applied to the circuit by connecting the battery B, an RC network 346 and 348 applies a reset to the bistable 345 and clears the device. This turns the MOSFET 343 off and insures that the rest of the gaming board is off. When the gaming board is connected to the system base station 10 and current is sourced into pin RxD of the communications connector, a transistor 350 turns on and applies a set signal to the bistable 345. This operation turns the MOSFET 343 on and with it the gaming board circuitry. When the program-controlling microprocessor 300 determines to power down the gaming board 12, it simply writes a zero into the power control bistable 345 through pin P22. The Q output of the power control bistable 345 is further connected by a diode 352 to its D input. This is to ensure that the bistable 345 will not inadvertently become set during the period when the power supply voltage to the microprocessor 300 is falling.

The gaming board 12 uses an audio annunciator which emits audible tones to congratulate a player for scoring a win pattern. Audible tones are also used to inform the player that he has lost at instant bingo, and to provide feedback for key presses. The device used to generate sonic energy for these annunciations is a piezoelectric bender 354. The bender 354 is a high-efficiency, high-impedance, low power audio transducer which can be driven by two alternating logic levels. In the illustrated embodiment, it is driven by the complementary outputs of a D-type bistable 356. In this manner, the bender element 354 sees a signal with a magnitude of approximately twice the power supply voltage Vcc, or about 10 Vac. Because the driving signal is a square wave, a tone from the bender element 354 is rich in harmonics and quite distinctive. The microprocessor 300 under program control toggles the bistable 356 at various frequency rates to produce different desired tones.

The display 314 comprises a display chip 360, a column driver chip 362 and a row driver chip 364. The display chip 360 is a large liquid crystal display (LCD) having a multiplexed sixteen-row by thirty-column matrix. Of the resulting 480 logical display elements, only 358 are actually used. They are arranged in an array of five rows each having five positions, where there are two digits in each position for a total of 50 digits. Each digit is in turn composed of seven segments, for a total of 350 segments. The annunciator bar has eight separate segments for annunciator flags. The display elements are normally clear but turn dark when excited by a voltage of sufficient magnitude.

The LCD driver chips 362 and 364 require four signals from the microprocessor 300. The first is a master timing signal LCDOSC for the LCD drivers. The LCDOSC is generated for the output of pin P20 of the microprocessor 300 after division by a D bistable 367. A signal LCDDAT carries data bits which are shifted into the drivers indicating which of the elements are to be displayed and is connected to the D inputs of both driver chips 362 and 364. The LCDDAT signal is generated from the output of pin P24 of the microprocessor 300. A signal ROWCLK clocks the data bits into the row driver 364 on its falling edge and a signal COLCLK clocks the data into the column driver 362 on its falling edge. The signals ROWCLK and COLCLK are generated from pins P26, P25, respectively, of the microprocessor 300. Because the LCD drivers 362, 364 operate from a power supply that is about 10 V, it is necessary to shift these four logic signals from the microprocessor 300 up to a higher voltage level. This is done through respective voltage level shifters 366, 368, 370 and 380.

The LCD driver chips 362 and 364, and shifters 366–370 and 380, require a voltage supply $V_{DD}$ of about 10 V. The gaming board 12 is powered by a battery B which delivers about 4.5 volts when fresh and about 3.5 volts when nearing depletion. The 10 volts required to supply the driver chips 362 and 364 is generated by a step-up voltage regulator 382. An external capacitor 384 on the input CX serves as a timing element for an oscillator internal to the regulator 382. By pumping current into and out of the capacitor 384, a triangular waveform is produced with a 50% duty cycle. The output voltage of the regulator 382 developed on capacitors 386 and 388 is divided down by resistors 390 and 394 and fed back to input VPB where it is compared against an internally generated reference of 1.3 V. If the feedback voltage is less than the reference, then the output LX of regulator 382 is turned on for one half-cycle of the oscillator, thereby shorting that point to ground.

While the output LX is grounded, current ramps up through an inductor 396 causing energy to be stored in its magnetic field. When the oscillator switches to the other half-cycle, the output LX shuts off and no longer sinks current. However, current continues to flow through the inductor 396, causing the voltage at a rectifier 398 to increase until it becomes forward-biased. Current flows through the rectifier 398, charging the output filter capacitors 386 and 388 until the energy stored in the inductor 396 is expended. The output voltage of the regulator 382 is controlled to 1.3 V * ((R390+R394)/R394) , which is designed to be about 10 V.

The regulator 382 can also be turned off by control of current to its input pin 1C. When current is removed from pin 1C, the regulator 382 shuts down, drawing almost no current. This prevents the regulator from stepping up the battery voltage, although a path still exists for current to flow from the battery B through the inductor 396 and the rectifier 398 to $V_{DD}$. To prevent unnecessary current drain when the display power supply is to be shut off, a MOSFET 400 is placed between the battery B and the inductor 396. When the gate of the MOSFET 400 is at a low logic level, the device is on, providing a low-impedance path for battery current to flow into the regulator circuit. When the gate of the MOSFET 400 is at a high logic level, the device shuts off, preventing current from flowing through the inductor 396 and the rectifier 398. A bistable 308 is used to turn the step-up regulator 382 on and off. The 1C input is connected to the Q output of the bistable 308; the gate of MOSFET 400 is connected to the *Q output of the bistable 308. The bistable 308 is set or reset by program control via the output pin P2l and the clock signal PROG. The bistable 308 is reset upon power on and whenever the gaming card 12 enters a power conservation mode.

The gaming board 12 has the sixteen membrane keyboard 312 (shown electrically in FIG. 25 and mechanically in FIG. 20) by which the player inputs numbers and functional commands. The sixteen keys of the keyboard correspond to the digits 0–9 and the six function keys described previously. The keyboard is a four-row by four-column key switch electrical matrix which shorts one row to one column when a single key is pressed. The rows and columns of the keyboard 312 are connected to port 1 pins P10–P17. The pins P10–P13 are for columns and the pins P14–P17 are for rows. To scan the keyboard for a key press, the row pins are pulled, one at a time, to a low logic level through pins P14–P17, and the column pins P10–P13, normally high, are checked by the microprocessor 300 for a low logic level. If only one row pin going low produces only one column pin low, then exactly one key has been pressed and that key is the one detected. Key debounce and edge detection are accomplished by the control program.

Figure 26A:
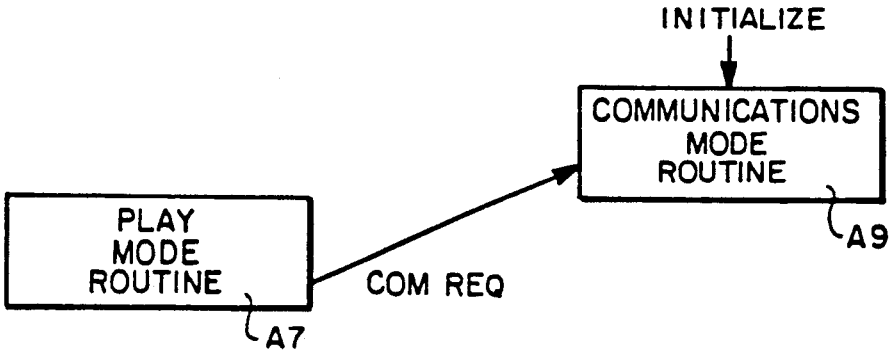
FIGS. 26A and 26B are a system flowchart of the control program which regulates the processes and signals of the microprocessor of the gaming board illustrated in FIG. 25.

FIG. 26A is a system flowchart of the programming for the control program stored in the gaming board 12 which operates to regulate the system. There are two main software portions of the control program, a communications mode routine illustrated as block A9 and a play mode routine illustrated as block A7. When the gaming board 12 is originally powered up by connection to the system base station 10, there is an initialization routine which is executed as part of the communications mode routine in block A9. If the gaming board 12 is not successfully programmed with a schedule of play, as well as game parameters and game cards, it will be powered down.

Once the gaming board 12 is successfully downloaded it enters the play mode routine in block A7. The play mode routine allows the player to display all the purchased cards, advance through the gaming schedule, score bingos, play instant bingo, and perform other functions provided by a function key. If a bingo is scored, whether regular or instant, a submode of the play mode routine is entered. A specific sequence of key presses is then required to return the gaming board to the regular play mode routine. This specific sequence is generally provided by the validator after communication with the validation unit 14.

At any time while the gaming board is in the play mode routine, the system base unit 10 or validation unit 14 can initiate communications with the gaming card 12 causing it to enter the communications mode routine. For example, if a bingo is scored, it must be validated, which requires communications with the validation unit 14. A return from the communications mode routine always places the gaming board 12 in the play mode routine.

Figure 26B:
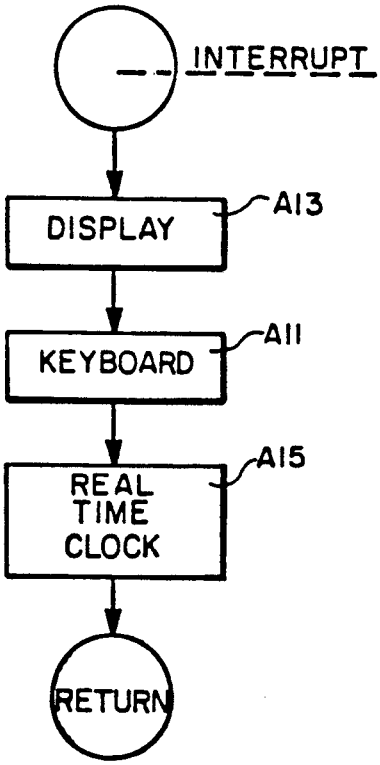

As shown in FIG. 26B, the main software routine executes an interrupt routine which is entered on a real-time basis from an internally-generated timer interrupt. At every interrupt, or at a predetermined number of interrupts, the program will branch to the routine and execute a keyboard scan routine in block A11, a display handler routine in block A13, and a real-time clock routine in block A15. After these routines are executed, the program returns to the main program at the location from which control was interrupted.

Thus, these processes are transparent to the operation of the main part of the program and facilitate its execution. To display a symbol on the display all that is needed is for the main program to store the appropriate symbol in certain memory locations. To use the keyboard, the main program simply checks one memory location to see if the key is ready and another memory location to fetch the key when the key is present. Further, to test how much time remains in the load mode, the main program reads a memory location which contains the time remaining. The interrupt routine provides these functions in the interrupt mode, which permits the main program to execute the normal sequence.

The keyboard scan routine in block A11 checks the keyboard a number of times a second and determines whether there is a valid key press. If there is a valid key press, a decoding routine places a number in a memory location indicating which key is activated.

The display handler routine in block A13 generates the four special signals LCDOSC, LCDDAT, ROWCLK, and COLCLK necessary to maintain the display. Further, it reads a set of memory locations, and the display storage, to determine which symbols the display should show and converts that data to the LCDDAT signal.

The real-time clock routine in block A15 is used to count interrupts to determine the passage of real time. An activity counter in block A15 determines the time elapsed since the last key activation.

Figure 27:
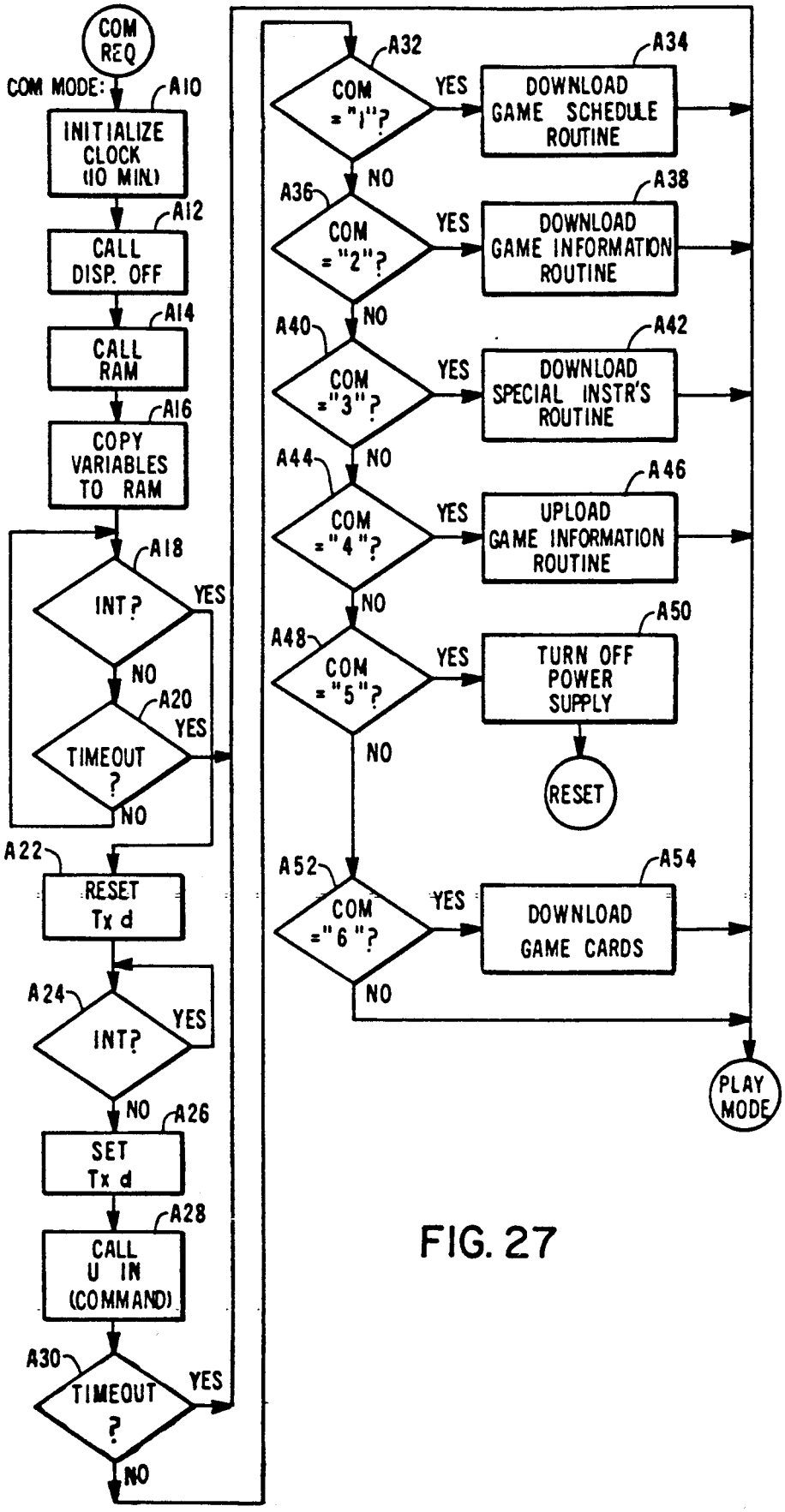
FIG. 27 is a more detailed flowchart of the control programs and subroutines illustrated in FIGS. 26A and 26B.

FIG. 27 is a detailed flowchart of the communications mode routine for the gaming board 12. The routine includes an initialization portion comprising blocks A10, A12, A14 and A16. In this initialization portion the activity counter is reset to ten minutes in block A10 and the display is turned off in block A12. Thereafter, the external RAM 812 is activated and initialized in block A11. In this manner, the RAM 812 may now copy blocks of data transmitted from the system base station 10. In block A18–A30 the communication linkage is developed to communicate with one of the external devices, such as a validation unit 14 or the system base station 10. Block A18 checks to see whether the gaming board 12 has received an interrupt from one of these external devices. If an interrupt is found, this indicates that an external device is requesting communications. Otherwise, the program loops through blocks A20 and A18 looking for either an interrupt or a time out. If the time out occurs first, then program control is transferred to the play mode.

However, if an external device is attempting to communicate, then in block A22 the gaming board 12 will set its transmit line Txd to 0 to respond to the interrupt. The program thereafter loops in block A24, waiting for the interrupt on the Rxd line to end. The disablement of the interrupt indicates that the external device has raised the Rxd line back to a logical 1, responding to the low logic level on the transmit line. Thus, the gaming board 12 will again reply in block A26, establishing the link by setting the transmit line Txd to a high logic level.

Next, in block A28 a subroutine UIN is called to input a command byte. If the command is received without a time out, then the program begins decoding it in blocks A32–A48. However, if the command is not received or there is an error in the communication, the program transfers to the play mode. Depending upon the command value, as tested in blocks A32, A36, A40, A44, A48 and A52, the gaming board 12 either downloads a block of information, such as the game schedule routine in block A34, the game information routine in block A38, or the special instructions routine in block A42, uploads a block of game information as in block A46, downloads gaming cards as in block A54, or turns off its power supply as in block A50.

If the command is a "1", as determined by an affirmative branch from block A32, then in block A34 the gaming board downloads the game schedule by calling the download game schedule routine. If the command is a "2", as determined by an affirmative branch from block A36, then in block A38 the gaming board downloads the game information by calling the download game information routine. In block A40 an affirmative branch calls the download special instructions routine in block A42 to transfer coding to the gaming board 12. Similarly, in block A52 an affirmative branch calls for the downloading of game cards to the gaming board 12. On a command of "5", control of the program is transferred from block A48 to block A50, where the power supply is turned off by resetting the power supply bistable. The commands "1", "2", "3", "5" and "6" are generated to the gaming board 12 by the system base station 10. If the command is a "4", then the gaming board 12 uploads game information in block A46 by calling the upload game information routine. A command of "4" is generated by a validation unit 14.

A command of "6" downloads game cards into the gaming board 12. The downloading occurs under cashier control in block A54, while selling cards 92. These cards are stored in a random access file containing a game card array library 62. The game card array library 62 may be stored in a disk drive 26, such as a hard drive or a floppy drive. However, other memory means may be used to store the gaming card library, including magnetic tape, read-only memory chips (ROMs), or random-access memory chips (RAMs and DRAMs).

Figure 28:
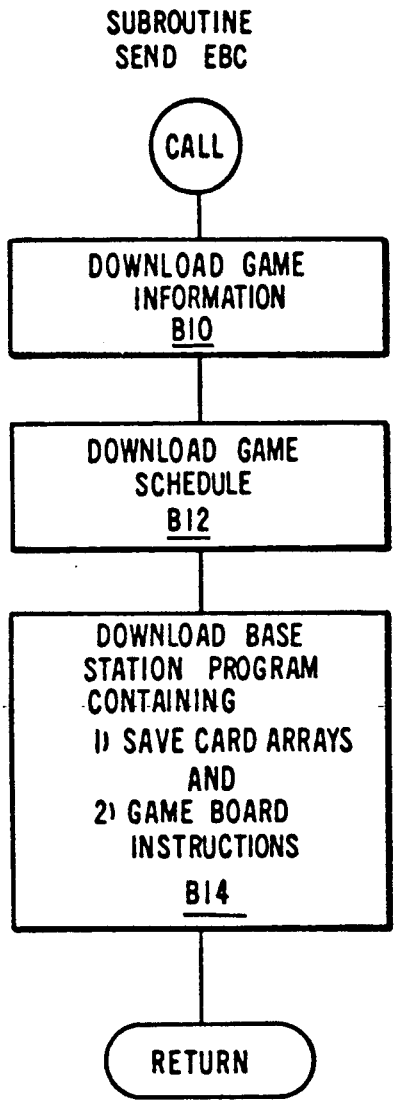
FIG. 28 is a flowchart of subroutine SEND EBC, executed by the system base station shown in FIG. 1, which downloads data into the electronic gaming boards.

FIG. 28 is a flowchart of the subroutine SEND.EBC executed by the system base station 10 when the user desires to download data from the system base station 10 to the gaming boards 12. The user may access SEND.EBC while the system base station 10 is in the cashier operations mode. SEND.EBC is used to download game information, game schedules, and a base station program 46 into the gaming boards 12.

Subroutine SEND.EBC downloads game information to the gaming board 12 by calling another subroutine, SEND.GAME, at block B10. After a return from SEND.GAME, in block B12 subroutine SEND.EBC downloads the game schedule into the gaming board 12 by calling a subroutine, SEND.SCHED. After the system base station CPU 22 executes SEND.SCHED, program control returns to block B14 where subroutine FIRMWARE is called. FIRMWARE downloads the base station program 50 into the gaming board 12. The base station program 50 includes gaming board instructions 46 as well as individual game array records 52. Upon execution of FIRMWARE, program control at the system base station CPU 22 is returned to the cashier operations routine.

Figure 29:
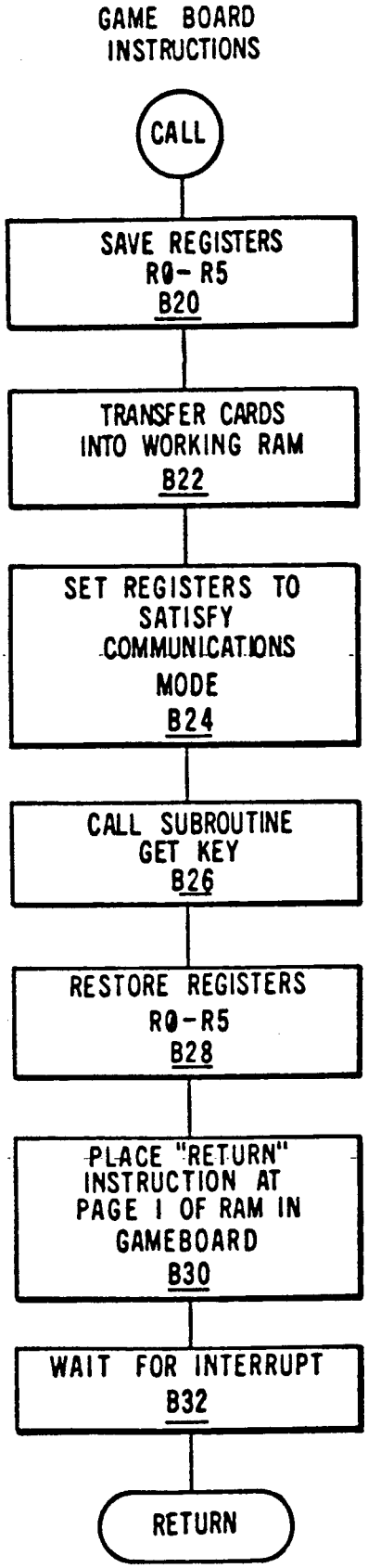
FIG. 29 is a flowchart of the gaming board instructions which are downloaded from the system base station of FIG. 1 into the electronic gaming board of FIG. 20.

FIG. 29 is a flowchart setting forth the structure of the base station program 46 which is downloaded from the system base station 10 into the gaming boards 12. The base station program commences at block B20 by saving registers R0–R5 in the random-access memory of gaming board 12. These registers are saved so that the gaming board 12 can resume its activities after the base station program 46 has been executed. Then, at block B22, the individual gaming card arrays 52 are transferred from the gaming board External RAM 812 into the gaming board Working Storage Area 814. In block B24, registers R0–R5 are set to satisfy the communications mode. Next, a subroutine GET KEY is called from block B26 which retrieves a character from the keyboard on the gaming board 12. At block B28, registers R0–R5 are restored to their initial values. A "RETURN" command is placed at the beginning of External Ram Page 1, 816, in block B30. Block B32 waits for an interrupt; once an interrupt is received, the gaming board exits the subroutine and returns to play mode operation.

Figure 30A:
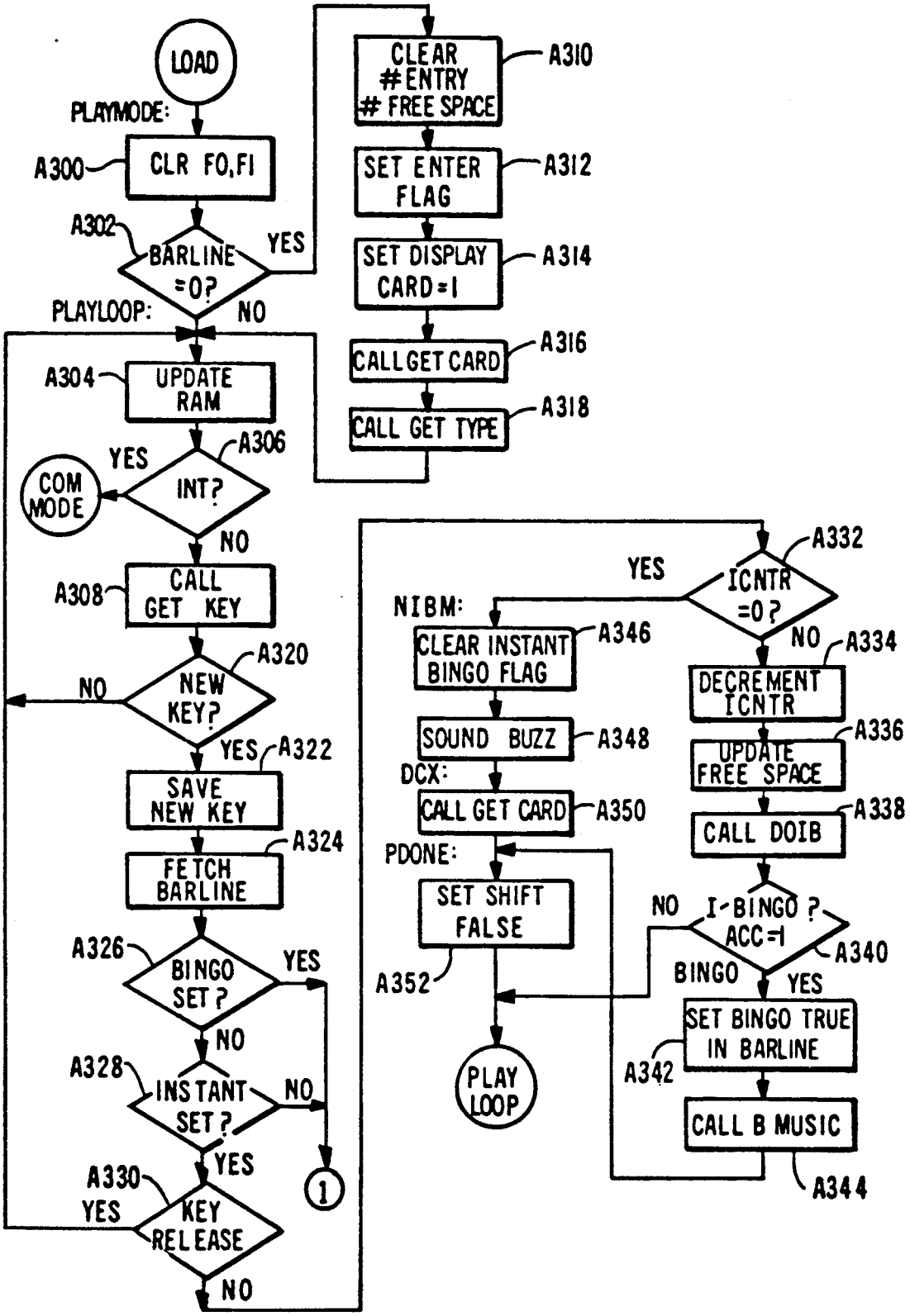
Figure 30C:
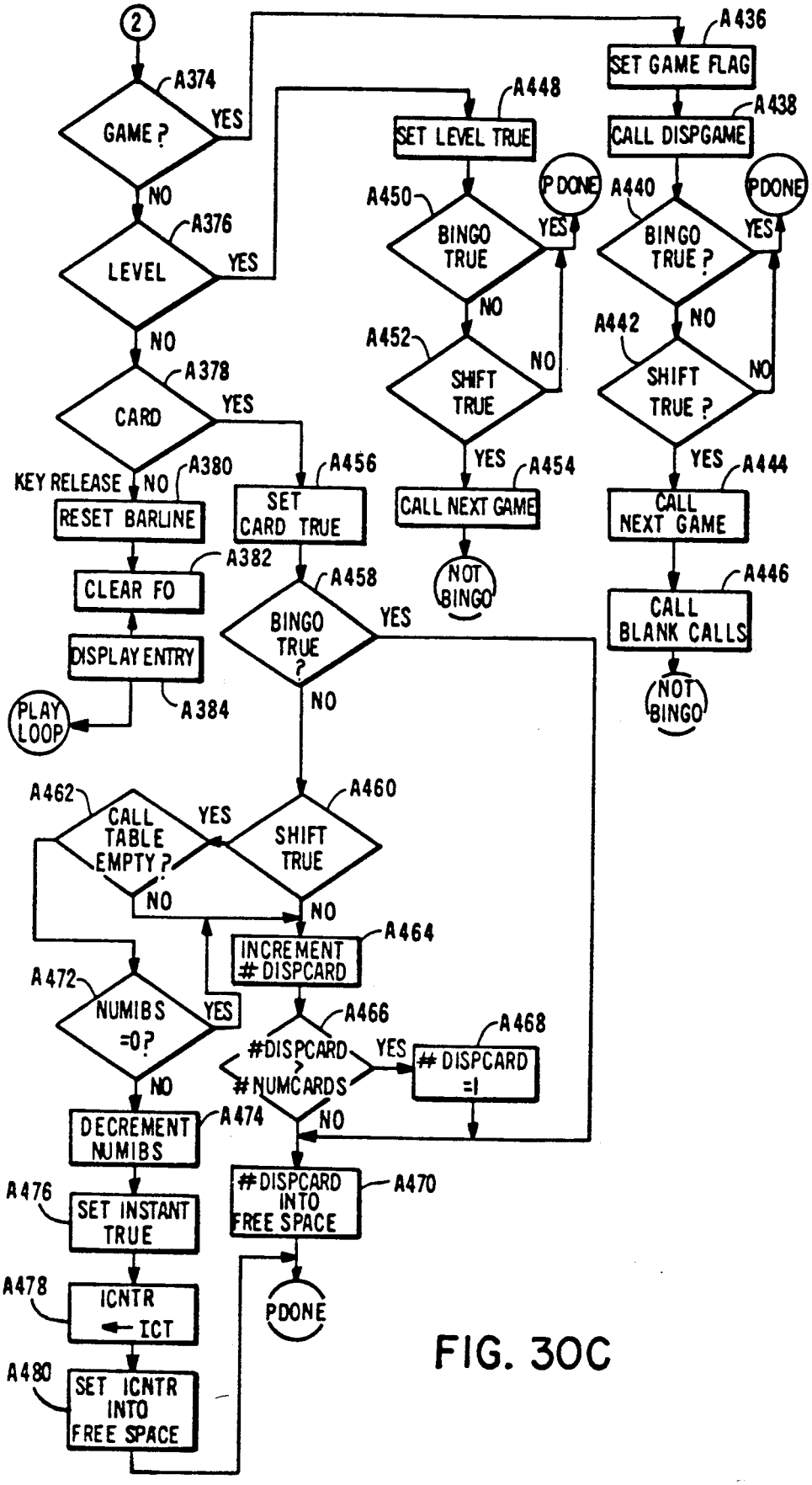

FIGS. 30A, 30B, and 30C together comprise a detailed flowchart of the play mode program for the gaming board 12. The program first clears the flag bits F0 and F1 in block A300 to set the play mode. Next in block A302, if the barline is clear, this indicates that the present pass is the first pass through the play mode, and therefore, a number of parameters must be initialized. This initialization process is performed in blocks A310–A318 where the memory locations storing the entry of a character and the free space are cleared in block A310, the enter flag is set in block A312, and the number of the card to be displayed is set to 1 in block A314. Thereafter, a subroutine labeled GET CARD is called in block A316 to obtain the stored numbers for the first card array so that they can be either matched or displayed. The subroutine GET CARD moves the array symbols from intermediate RAM storage to display storage. In addition, the type of card is fetched by calling the subroutine labeled GET TYPE in block A318.

After the initialization, the program transfers control to block A304 where the RAM memory is updated. If this is not the first pass through the play mode, then the negative branch from block A302 directly transfers control to block A304. After initialization of the RAM in block A304, block A306 tests for an interrupt. If the interrupt is present, this indicates that the gaming board 12 is connected to either the system base station 10 or the validation unit 14 and a communications request is present. The gaming board 12 will, in response to the request, exit to the communications mode. If there is no communications request, in block A308 the program calls the subroutine GET KEY which reads the key input from the key scan routine. Block A320 determines if a new key has been input. Upon the receipt of a new key, it is saved in block A322; otherwise, the program returns to the address PLAYLOOP in block A304. In this manner the program will continuously scan for a new key and if it does not find one, return to the beginning of the loop to check for a communications request. After a new key has been found, and saved in block A322, the program continues to block A32 where the status of the gaming board is determined by fetching the annunciator byte. In blocks A326 and A328, the status bits are tested to determine whether bingo is set and whether the instant annunciator is set.

If the bingo annunciator is not set (block A326) and the instant annunciator is set (block A328), the program affirmatively branches to block A330. The program in block A330 tests the key input to determine if it was merely a key release. If the new key is merely a release of the present key, the program will exit back to the address PLAYLOOP, block A304. However, if there is an actual new key and the instant annunciator is set, then the program will begin to play instant bingo. This loop is entered through block A332 where the address ICNTR is tested to determine whether or not it is zero. This address is used to store the number of key pushes that a player is allowed in an attempt to win at an instant game. If the instant counter is zero, as determined by an affirmative branch from block A332, then the game is finished and the instant bingo flag is cleared in block A346. Further, in block A348 a buzzing sound is generated to alert the player that he has lost the instant game. Next, in block A350, the subroutine GETCARD is again called to obtain the next card array in line, so that if there are more instant bingo games, the program re-enters this mode at block A304. Before leaving the loop, at block A352 the shift bit is set false.

However, if the instant counter ICNTR is not zero, the player still has a number of pushes with which to win at instant bingo. Therefore, the negative branch from block A332 continues the program at block A334 where the counter ICNTR is decremented. This number is then placed into the free space in block A336 to inform the player of how many pushes he is still allowed. Thereafter, in block A338, the subroutine DOIB is called to select a random number and to match it against the card in play. The subroutine DOIB returns to the main program loop with the accumulator set to either 0 or 1, indicating that instant bingo has been lost or won, respectively. If the program returns with the accumulator set to 1, program control is transferred to block A342 where the bingo annunciator is set. To alert the player that a bingo for the instant mode has been found, a characteristic tune is played in block A344 with the tone generator by calling the subroutine BMUSIC. Thereafter, the program exits back to PLAYLOOP, block A304, after setting the shift annunciator bit in block A352.

When it is determined that the instant annunciator has not been set and the gaming board is either in a bingo or not bingo mode, the program will continue to blocks A354 and A356 where the status of the board is tested. The annunciators are fetched in block A354 and tested in block A356 to determine whether the instant and bingo annunciators are both set. If both are set, the program moves to block A358, where the input DIGIT is tested. When DIGIT is 0, this signifies that the player has pushed the key sequence 0-Shift-Enter on the gaming board 12, which will reset the gaming board from the bingo mode to the regular play mode. Consequently, if DIGIT is 0 (block A358), or if at least one annunciator is not set (block A356), the gaming board 12 will begin a path in blocks A360–A378. If DIGIT is not 0, the gaming board 12 should not input key strokes; therefore, the program will loop back to the address PLAYLOOP, block A304.

Block A360 decodes the character entered into the keyboard. If the entered key is a digit between 0 and 9, control will be transferred to block A416. If not, successive tests are performed at blocks A362, A364, A370, A372, A374, A376 and A378 until an affirmative answer is found or all the tests are negative. If the key entered is a shift command as sensed in block A362, then control will be transferred to block A366. If the command is an enter operation, then control will be transferred at block A364 to block A368.

At block A370, the program determines whether the instant annunciator bit is set. If the annunciator bit is true (1), then the program loops back to the address PLAYLOOP, block A304. However, if the annunciator bit is false (0), the program will continue decoding the new input key. In block A372, the recall instruction is decoded; if the test is affirmative, control is transferred to block A426. In block A374, the game key is tested; if the test is true, a path beginning with block A436 is initiated. In block A376, the level key is tested. If the test is affirmative, control is transferred to block A448. The last function to be tested is the card key in block A378. If the card key was pressed, the program will enter a subroutine at block A456.

However, if none of these keys have been entered, the gaming board 12 determines that an invalid request has been made and resets the bar line in block A380. Further, the recall mode is reset by clearing the function bit F0 in block A382. The key that was entered is displayed in block A384 before the program transfers to the address PLAYLOOP, block A304.

If the key entered was determined to be a numeric digit between 0 and 9, block A416 is executed where the enter flag bit is cleared. Block A418 checks for a previous enter flag bit and if there is one, that is, when the enter flag is not zero, block A420 clears both sides of the free space on the gaming board 12. If not, or after the free space is cleared, in block A422 a subroutine labelled ROLLIS 1 is called. The ROLLIS 1 subroutine places the first digit in the free space on the right-hand side, the left-hand side remaining cleared, i.e., 0. The digit that is in the free space is then saved in entry location ENTRY in block A424 before the program exits to the address PDONE, block A352. If a second digit is selected, the loop repeats, shifting program control back to block A422, where the subroutine ROLLIS1 rolls the first digit to the left-hand side of the free space and admits the second digit to be entered on the right-hand side of the free space. The second digit is saved at block A424, and the program again exits to PDONE, block A352. The player will presumably press the Enter key 210 after making the selection of digits.

If the Shift key was entered, block A366 sets the shift bit to true in block A366 before exiting to the address PLAYLOOP, block A304. Likewise, the enter flag is set in block A368 if the Enter key was pressed, as after the selection of digits. Control is then transferred to block A386 where the last digit entered is checked to determine whether or not it is a "0". If it is, then a path beginning at block A410 is initiated to determine whether a player has pressed the special key sequence of 0-Shift-Enter which instructs the gaming card to exit the bingo mode. If the test is not passed, then the negative branch from block A410 exits to the address PDONE at block A352. If a player has entered the special key sequence, the program continues to block A412 where a subroutine BEEP is called. This subroutine BEEP causes the gaming card 12 to emit audible tones, warning both the floor worker and the bingo player that the gaming card is no longer in the bingo mode.

Generally, this sequence is used to reset the card after a bingo has been validated by the instant annunciator bit in block A414. Then the program resumes its search for other bingos by calling the subroutine BCRESUME in block A396. The subroutine BCRESUME places a "1" in the accumulator if any of the remaining cards contain winning bingo patterns. At block A398, a positive test transfers control to block A342 where the bingo annunciator is set. The gaming board plays the winning bingo tune by calling the subroutine BMUSIC in block A344. However, if no bingo is found in the rest of the cards and the instant annunciator was not set in block A414, the instant and bingo annunciators are cleared in block A400 before the program exits to the address DCX. An exit to this address produces a call to the subroutine GET CARD to set the next card in block A350. The shift annunciator is cleared in block A352 before exiting to PLAYLOOP in block A304.

If the desired operation is the routine entry of a called number to be checked against the card arrays, the negative branch of the test in block A386 continues the program to block A388, where, if there are no cards to be played, the program exits to the address PLAYLOOP at block A304. However, if there are cards, the shift annunciator is tested in block A390. If true, the program will continue to block A402, where the bingo annunciator is tested. A true bit in block A402 will cause the program to exit to address PDONE.

If the bingo annunciator bit is not set, this indicates the routine entry of a called number, thereupon, the subroutine ENTERCALL will be called in block A404. This subroutine enters the two digits of a called number into the call table so that all the enabled bingo card arrays in present play can be checked against the call table. After the bit in the call table is set, the table is matched against all the cards by a subroutine BING CHECK in block A406. The subroutine BING CHECK will return with the accumulator set at 1 if a bingo is found. The bingo condition is tested in block A408; if the accumulator contains a "1", control is transferred to the address BINGO, block A342. If there is no bingo at this point, then the program loops back to block A400 where the instant flag and the bingo flag in the annunciator bar are cleared. The program thereafter exits to the address PLAYLOOP after performing the operations in blocks A350 and A352.

Figure 31:
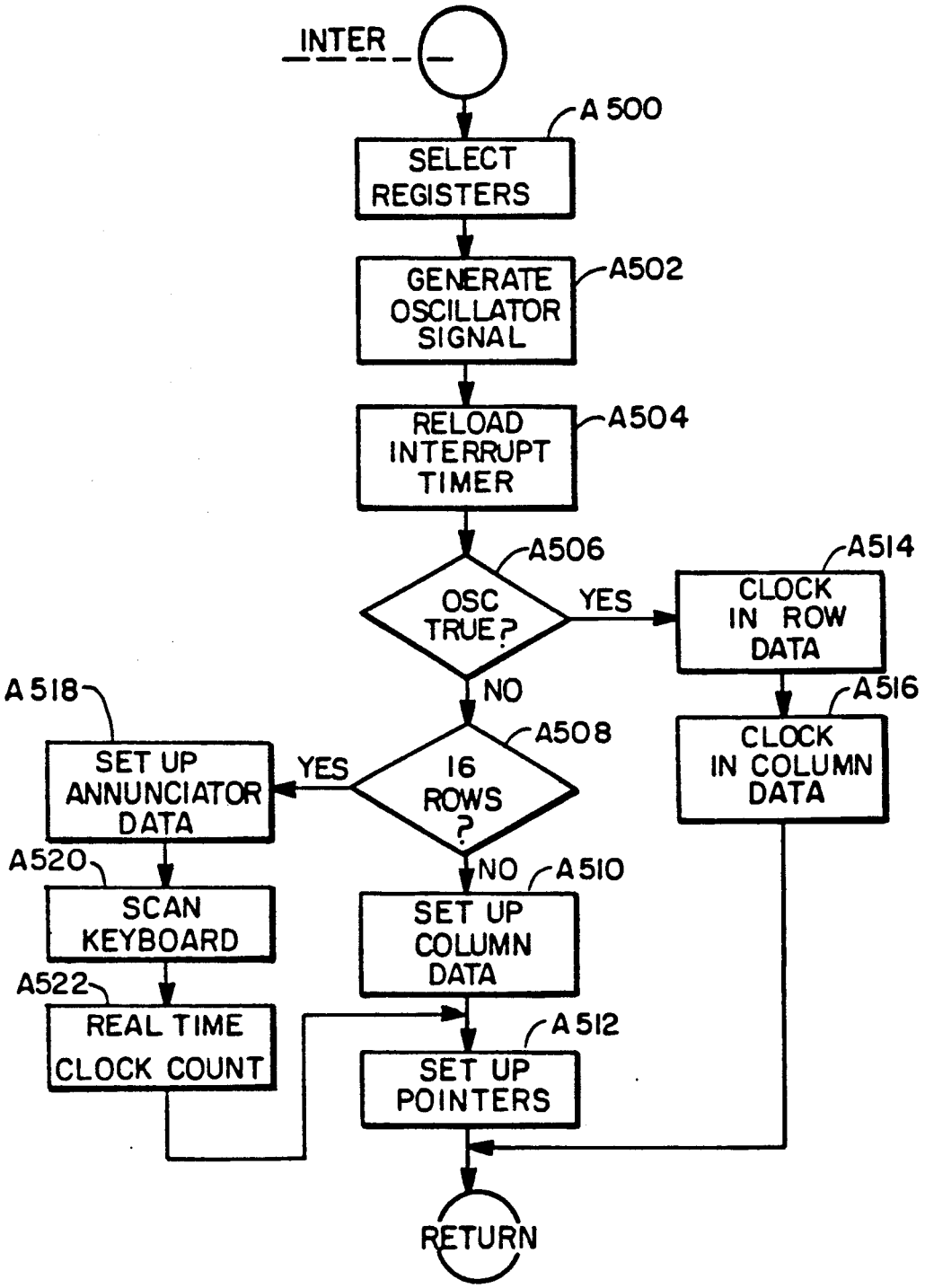
FIG. 31 is a detailed flowchart of the interrupt routine included in the program illustrated in FIGS. 26A and 26B.

FIG. 31 is a detailed flowchart of the interrupt routine illustrated in FIGS. 26A and 26B. When an interrupt occurs from the internal timer, program control is transferred to block A500, where the background bank of registers is selected. This register bank is used by the interrupt routine which may store information between interrupts. Therefore, the main routine should operate without using or modifying the contents of these registers. Next, in block A502, the routine generates the oscillator signal LCDOSC from pin 20 of the microprocessor 300. The master time clock for the display must be toggled precisely every 960 microseconds and cannot wait until other tasks in the main program are completed. Therefore, the counter-timer circuit inside the microprocessor is used to generate an interrupt every 60 microseconds. After the oscillator signal has been generated, in block A504 the timer is reloaded to begin timing for the next interrupt.

Alternate paths are now taken from block A506 depending upon the outcome of a test that determines whether the oscillator logic level is high or low. If LCDOSC is low, a test for 16 rows is made in block A508, until 16 rows have been attained. A negative test result advances the program to block A510 where a string of column data is prepared to be sent to the LCD driver circuits on the next interrupt. If LCDOSC is high, blocks A514 and A516 shift the previously-prepared data into the driver circuits. When the 16 rows have been attained as tested in block A508, the data setup routine sets up annunciator bar data at block A518 as well as data which will drive the seven-segment digital display. The data for the display is completely set up after fifteen passes through the loop; the sixteenth pass sets up the data for the annunciator bar. During the sixteenth pass, the keyboard scan and real-time clock functions are performed in blocks A520 and A522, respectively. Block A508 transfers control either to block A518 or to block A510, depending upon the number of times the loop has been executed.

The data to be displayed are stored in the 26 bytes of the display storage. The display storage is logically organized as five groups of five bytes where each byte holds two digits. One additional byte holds the eight annunciator bits. In this manner, the main program merely writes a byte to the appropriate location in the display storage. The byte will show up on the display after the interrupt-driven display routine is performed. The display data setup routine in blocks A510 and A512 examines a group of five bytes, looks up the appropriate segment bits from a table, and places the segment bits in a segment storage area. During the next interrupt, the transmit routine in blocks A514 and A516 sends the bits from the storage area to the display hardware. On the sixteenth time through the setup routine, the lookup table is addressed for the annunciator bits.

On every 32nd interrupt, the keyboard scan and real-time clock routines in blocks A520 and A522 are executed. The keyboard scan loop probes each of the four rows of the 4×4 keypad with a low logic level and looks for a low logic level on one of the column pins. If exactly one row makes exactly one column go low, then one and only one key has been pressed. The row/-column pattern is converted to a numerical value by means of a lookup table. If the same key is actuated on two consecutive passes through the keyboard scan routine, then a valid key is detected. If a transition from an invalid key to a valid key is detected, then a flag byte is set to inform the main program that a new key is available. At the same time, the activity counter in block A15 is reinitialized to ten minutes.

The real-time clock routine follows the keyboard scan. On every pass through the real-time clock routine, an interrupt is counted which represents 1/33 of a second. When a second has been counted, the counter is updated and can be tested by the main routine to determine the time interval since the last key activation. When the activity counter times out, indicating that a key has not been pressed for ten minutes, the gaming board 12 turns off the display power supply to conserve power, and the microprocessor 300 enters an idle loop. In this idle loop, the microprocessor 300 waits for a key to be pressed or for input from an external device. If neither of these events occurs within two hours, the microprocessor 300 will turn off the main power supply and power down completely. If a key is activated after the display power is turned off, but before the main power supply is shut down, the gaming board 12 simply resumes normal operations and executes the required programming steps for interpreting the key. However, once the main power has been shut off, a reconnection to the system base station 10 is required for initialization before power can be turned back on.

While a preferred embodiment of the invention has been illustrated, it will be obvious to those skilled in the art that various modifications and changes may be made thereto without departing from the spirit and scope of the invention as defined in the appended claims.

What is claimed is:

1. A method for managing money during the playing of a bingo game, including the steps of:

(a) electronically storing in a system base station the total number of bingo cards sold during the course of a gaming session comprised of a scheduled sequence of one or more successive, independent bingo games;

(b) electronically storing in a system base station the amount of all winning bingo card payouts made during said gaming session;

(c) electronically storing in a system base station a validation code which uniquely identifies each specific said gaming session;

(d) downloading said validation code and data representing at least one bingo card into at least one handset;

(e) electronically storing said validation code and said bingo card in memory means of said handset; and (f) confirming a win condition of said handset by comparing said validation code electronically stored in said system base station with said validation code electronically stored in said handset, and producing a win indication if said validation codes are identical.

2. A method as set forth in claim 1 further including the step of electronically storing in a system base station:

(a) an identification code which uniquely defines each individual electronic bingo gaming board used during the playing of said bingo game;

(b) an identification code which uniquely defines the game participant assigned to each said individual electronic gaming board;

(c) the number of bingo cards sold to each game participant during the course of said gaming session; and (d) a unique numerical code which identifies the game participant receiving each said winning bingo card payout.

3. A method as set forth in claim 1 wherein said system base station electronically calculates a profit/loss statement for said gaming session.

4. A method as set forth in claim 1 wherein said system base station electronically calculates a cash-on-hand balance for said gaming session.

5. A method of managing cash during the playing of a bingo game, including the steps of:

(a) electronically storing in a system base station prices to be charged for individual bingo cards;

(b) electronically storing in said system base station prices to be charged for at least one bingo card package, said bingo card packages each containing a plurality of individual bingo cards;

(c) electronically storing in said system base station the number of individual bingo cards sold for each of one or more successive, independent bingo games during the course of a gaming session comprised of a scheduled sequence of one or more successive, independent bingo games;

(d) electronically storing in said system base station the numbers of respective bingo card packages sold during the course of said gaming session;

(e) electronically storing in said system base station the amount of each winning bingo card payout made during said gaming session; and (f) electronically storing in said system base station a validation code which uniquely identifies each specific said gaming session.

6. A method as set forth in claim 5 further including the steps of:

(g) electronically storing in memory means of said system base station an identification code which uniquely defines each individual electronic bingo gaming board used during the playing of said bingo game;

(h) electronically storing in memory means of said system base station an identification code which uniquely defines the game participant assigned to each said individual electronic gaming board;

(i) electronically storing in memory means of said system base station the number of bingo cards sold to each game participant during the course of said gaming session;

(j) electronically storing in memory means of said system base station the numbers of respective bingo card packages sold to each game participant during the course of said gaming session; and (k) electronically storing in memory means of said system base station a unique numerical code which identifies the game participant receiving said wining bingo card payout.

7. A method as set forth in claim 5 wherein said system base station produces a profit/loss statement for said gaming session.

8. A method as set forth in claim 5 wherein said system base station produces a numerical value representing cash-on-hand balance for said gaming session.

9. An electronic gaming system for managing accounting during a bingo game comprising:

memory means for electronically storing the total number of bingo cards sold during the course of a gaming session comprised of a scheduled sequence of one or more successive, independent bingo games;

memory means for electronically storing all winning bingo card payouts made during said gaming session; and memory means for electronically storing a validation code which uniquely identifies each specific said gaming session.

10. An electronic gaming system as set forth in claim 9 further comprising:

memory means for storing an identification code which uniquely defines each individual electronic bingo gaming board used during the playing of said bingo game;

memory means for storing an identification code which uniquely defines the game participant assigned to each said individual electronic gaming board;

memory means for storing the number of bingo cards sold to each game participant during the course of each said gaming session; and memory means for storing a unique numerical code which identifies the game participant receiving said payout.

11. An electronic gaming system as set forth in claim 9 wherein said system base station further includes calculating means for producing a profit/loss statement for said gaming session.

12. An electronic gaming system for managing accounting during a bingo game as set forth in claim 9 further including calculating means for producing a numerical value representing cash-on-hand balance for said gaming session.

13. An electronic gaming system which manages accounting during a bingo game comprising:

memory means for electronically storing prices to be charged for individual bingo cards and prices to be charged for bingo card packages consisting of a plurality of said individual bingo cards;

memory means for electronically storing the number of individual bingo cards sold during the course of a gaming session comprised of a scheduled sequence of one or more successive, independent bingo games;

memory means for electronically storing the number of bingo card packages sold during the course of said gaming session;

memory means for electronically storing a validation code which uniquely identifies each specific said gaming session.

14. An electronic gaming system for managing accounting during a bingo game as set forth in claim 13 wherein the following data are stored in memory means of said system base station;

(a) said prices to be charged for individual bingo cards, (b) said prices to be charged for bingo card packages, (c) said number of individual bingo cards sold during the course of said gaming session, (d) said number of bingo card packages sold during the course of said gaming session, (e) said all winning bingo card payouts made during the course of said gaming session; and (f) said validation code.

15. An electronic gaming system for managing accounting during a bingo game as set forth in claim 13 further including calculating means for producing a profit/loss statement for said gaming session.

16. An electronic gaming system for managing accounting during a bingo game as set forth in claim 13 further including calculating means for producing a cash-on-hand balance for said gaming session.

17. A method of providing security checks during the playing of a bingo game, including the steps of:

(a) setting up a validation code unique to a specific gaming session, said gaming session being comprised of a scheduled sequence of one or more successive, independent bingo games;

(b) blocking said validation code such that said code cannot be changed by an unauthorized individual;

(c) distributing electronic gaming boards and said validation code to individual players; and (d) when a player claims to have a winning bingo card, then comparing said validation code stored in an electronic gaming board containing said winning bingo card with said validation code stored in a system base station and validating said bingo card as a bingo card issued for one specific said gaming session if said validation codes match.

18. A method of providing security checks during the playing of a bingo session comprised of a scheduled sequence of one or more successive, independent bingo games, including the steps of:

(a) creating a gaming card library comprising a plurality of unique bingo card arrays wherein each individual bingo card array is assigned an identifier unique to specific said bingo card array;

(b) transmitting said bingo card arrays and said identifiers to electronic gaming boards;

(c) storing said bingo card arrays and said record numbers in memory means of electronic gaming boards;

(d) validating win claims by comparing said identifier stored in the respective said electronic gaming board with said identifier stored in said gaming card library.

19. A method of providing security checks during the playing of a bingo session as set forth in claim 18 wherein said gaming card library is stored in memory means of a system base station.

20. An electronic gaming system comprising a system base station and a plurality of electronic gaming boards, said electronic gaming system providing security checks during the playing of a bingo session comprised of a scheduled sequence of one or more successive, independent bingo games, said system base station including:

input means for entering a validation code, which is a unique identifier for a specific gaming session comprised of a scheduled sequence of one or more successive independent bingo games, into said system base station;

memory means for storing said validation code;

security means for blocking said validation code such that said code cannot be changed by an unauthorized individual;

distribution means for distributing electronic bingo cards and said validation code to said gaming board;

comparison means for comparing said validation code stored in said memory means with said validation code received from said electronic gaming board.

21. An electronic gaming system comprising a system base station and a plurality of electronic gaming boards, said electronic gaming system providing security checks during the playing of a bingo session comprised of a scheduled sequence of one or more successive, independent bingo games, said electronic gaming boards including:

input means for entering a validation code, which is a unique identifier for each said specific gaming session, into said electronic gaming board;

memory means for storing said validation code;

input means for accessing said validation code from said electronic gaming board; and security means for blocking said validation code such that said code cannot be changed by an unauthorized individual.

22. An electronic gaming system comprising a system base station and a plurality of electronic gaming boards, said electronic gaming system providing security checks during the playing of a bingo session comprised of a scheduled sequence of one or more successive, independent bingo games, said system base station including:

memory means for storing a gaming card library consisting of a plurality of unique bingo card arrays, each of said unique bingo card arrays representing an individual bingo card, wherein each individual bingo card array is assigned a unique identifier;

input means for entering said gaming card library into said memory means;

a system base station communications port for transmitting said gaming card arrays and said record numbers to said electronic gaming boards;

comparison means for comparing said record number stored in said memory means with said record number stored in said electronic gaming board.

23. An electronic gaming system for providing security checks during the playing of a bingo session as set forth in claim 22 wherein said system base station further includes display means for displaying the specific bingo card array corresponding to a selected identifier.

24. A method of providing security checks during the playing of a gaming session comprised of a schedule sequence of one or more successive, independent bingo games, including the steps of:

(a) reading at least a portion of a validation code from an electronic gaming board, wherein said validation code is a unique identifier for each specific said gaming session, and wherein said electronic gaming board is adapted to play a game such as bingo;

(b) comparing said portion of validation code read from said electronic gaming board with a corresponding portion of a validation code stored in a system base station, wherein said validation code stored in said system base station is fixed prior to the commencement of a gaming session;

(c) reading a record identifier from said electronic gaming board, wherein said record identifier is a unique identifier assigned to a specific gaming card array, each of said unique gaming card arrays representing an individual bingo card;

(d) entering said record identifier into input means of said system base station;

(e) said system base station, in response to receiving said record number, causing the display of said specific game card array corresponding to said record number.

25. A method of providing security checks during the playing of a bingo session as set forth in claim 24 wherein said steps are performed upon receipt of a win condition from said electronic gaming board.

26. A method of providing security checks during the playing of a bingo session as set forth in claim 25 wherein the matching of respective said validation codes and the matching of respective said record numbers constitutes confirmation of a win.

27. A method of providing security checks during the playing of a bingo session as set forth in claim 26 wherein said system base station prints out a written confirmation of a win.

28. A method of providing security checks during the playing of a bingo session as set forth in claim 24 further comprising the following steps:

(a) selling said gaming cards to game participants;

(b) selecting a random bingo number;

(c) announcing said random bingo number to all game participants;

(d) repeating steps (b) and (c) until at least one electronic bingo gaming board provides an indication of a win;

(e) verifying an electronic gaming board when said electronic gaming board provides an indication of a win by comparing said validation code stored in memory means of said gaming board with said validation code stored in memory means of said system base station.

29. A method of providing security checks during the playing of a bingo session as set forth in claim 28, said method utilizing a first password and a second password, wherein:

(a) an authorized individual must enter a first password into input means of a system base station in order to access a cashier menu which provides for the sale of gaming card arrays; and (b) an authorized individual must enter a second password into said input means of said system base station in order to access a managerial menu which provides for the display of accounting information such as a profit/loss statement and a cash-on-hand balance.

30. A method of providing security checks during the playing of a bingo session as set forth in claim 29 wherein memory means of said system base station stores a record of all entered passwords.

* * * * *

UNITED STATES PATENT AND TRADEMARK OFFICE

CERTIFICATE OF CORRECTION

PATENT NO. : 5,007,649

DATED : April 16, 1991

INVENTOR(S) : John Richardson

It is certified that error appears in the above-identified patent and that said Letters Patent is hereby corrected as shown below:

In Column 41, lines 63 and 64 (Claim 13, between lines 14 and 15), after the word "session;" insert the paragraph:

--memory means for electronically storing all winning bingo card payouts made during the course of said gamming session; and--.

In Column 42, line 2 (Claim 14, line 4), after the word "station" change the semicolon ";" to a colon --:--.

In Column 43, line 58 (Claim 24, line 2) change "schedule" to read the word --scheduled--.

Signed and Sealed this

Seventeenth Day of November, 1992

*Attest:*

DOUGLAS B. COMER

*Attesting Officer*

*Acting Commissioner of Patents and Trademarks*